US011514865B2

(12) United States Patent
Shan

(10) Patent No.: US 11,514,865 B2
(45) Date of Patent: Nov. 29, 2022

(54) DRIVING CIRCUIT AND DRIVING METHOD THEREOF, DISPLAY PANEL, AND DISPLAY DEVICE

(71) Applicants: CHENGDU BOE OPTOELECTRONICS TECHNOLOGY CO., LTD., Sichuan (CN); BOE TECHNOLOGY GROUP CO., LTD., Beijing (CN)

(72) Inventor: Dongxiao Shan, Beijing (CN)

(73) Assignees: Chengdu BOE Optoelectronics Technology Co., Ltd., Sichuan (CN); Beijing BOE Technology Development Co., Ltd., Beijing (CN)

( * ) Notice: Subject to any disclaimer, the term of this patent is extended or adjusted under 35 U.S.C. 154(b) by 4 days.

(21) Appl. No.: 17/333,114

(22) Filed: May 28, 2021

(65) Prior Publication Data

US 2021/0407434 A1 Dec. 30, 2021

(30) Foreign Application Priority Data

Jun. 30, 2020 (CN) ..... 202010617318.X

(51) Int. Cl.
*G09G 3/3275* (2016.01)
*G09G 3/3266* (2016.01)

(52) U.S. Cl.
CPC ..... *G09G 3/3275* (2013.01); *G09G 3/3266* (2013.01); *G09G 2300/0833* (2013.01)

(58) Field of Classification Search
CPC ..... G09G 3/3275; G09G 3/3266
See application file for complete search history.

(56) References Cited

U.S. PATENT DOCUMENTS

2011/0130981 A1 6/2011 Chaji et al.
2012/0056537 A1 3/2012 Koyama
2016/0019836 A1 1/2016 Qing et al.
(Continued)

FOREIGN PATENT DOCUMENTS

CN 201197211 2/2009
CN 102376239 3/2012
(Continued)

OTHER PUBLICATIONS

Chinese First Office Action (w/ English translation) for corresponding CN Application No. 202010617318.X, 18 pages.
(Continued)

*Primary Examiner* — Nelson M Rosario
*Assistant Examiner* — Scott D Au
(74) *Attorney, Agent, or Firm* — Dority & Manning, P.A.

(57) ABSTRACT

A driving circuit includes at least one pixel circuit and a control circuit. A pixel circuit is configured to write a first data signal in response to a scan signal, and generate a first driving signal according to a first signal and the first data signal. The control circuit is configured to monitor the first driving signal and provide another first data signal to the pixel circuit according to a second data signal and the first driving signal. The pixel circuit is further configured to provide another first driving signal to a light-emitting device according to the first signal and the another first data signal, and in response to an enable signal of the enable signal terminal, provide a second driving signal to the light-emitting device according to a second signal and the another first data signal.

20 Claims, 15 Drawing Sheets

(56) References Cited

U.S. PATENT DOCUMENTS

| | | | |
|---|---|---|---|
| 2017/0270860 | A1 | 9/2017 | Wang et al. |
| 2018/0005579 | A1 | 1/2018 | Brahma et al. |
| 2018/0137819 | A1 | 5/2018 | An et al. |
| 2018/0166515 | A1 | 6/2018 | An et al. |
| 2018/0357963 | A1 | 12/2018 | Gai et al. |
| 2020/0168156 | A1 | 5/2020 | Yin |
| 2021/0012709 | A1 | 1/2021 | Qian et al. |

FOREIGN PATENT DOCUMENTS

| | | |
|---|---|---|
| CN | 105632429 | 6/2016 |
| CN | 106531082 | 3/2017 |
| CN | 106652968 | 5/2017 |
| CN | 110349534 | 10/2019 |

OTHER PUBLICATIONS

Chinese Notification to Grant Patent Right for Invention (w/ English translation) for corresponding CN Application No. 202010617318.X, 7 pages.

DRIVING CIRCUIT AND DRIVING METHOD THEREOF, DISPLAY PANEL, AND DISPLAY DEVICE

CROSS-REFERENCE TO RELATED APPLICATION

This application claims priority to Chinese Patent Application No. 202010617318.X, filed on Jun. 30, 2020, which is incorporated herein by reference in its entirety.

TECHNICAL FIELD

The present disclosure relates to the field of display technologies, and in particular, to a driving circuit and a driving method thereof, a display panel and a display device.

BACKGROUND

Compared with a liquid crystal display (LCD), an organic light-emitting diode (OLEO) display has advantages such as low power consumption, low production cost, self-luminosity, wide viewing angle, quick response, etc., and has become a hot spot of research at the moment.

SUMMARY

In one aspect, a driving circuit is provided. The driving circuit includes at least one pixel circuit and a control circuit. Each pixel circuit is coupled to a scan signal terminal, a first data signal terminal, a second signal terminal, and an enable signal terminal. The control circuit is coupled to a second data signal terminal and the at least one pixel circuit. The pixel circuit is configured to write a first data signal received at the first data signal terminal in response to a scan signal received at the scan signal terminal; and generate a first driving signal according to a first signal and the first data signal. The control circuit is configured to monitor the first driving signal, and provide another first data signal to the pixel circuit according to a second data signal received at the second data signal terminal and the first driving signal. The pixel circuit is configured to be further coupled to a light-emitting device, and is further configured to: provide another first driving signal to the light-emitting device according to the first signal and the another first data signal; and in response to an enable signal received at the enable signal terminal, provide a second driving signal to the light-emitting device according to a second signal received at the second signal terminal and the another first data signal. An amplitude of the another first driving signal and an amplitude of the second driving signal are approximately equal.

In some embodiments, the pixel circuit is configured to provide the another first driving signal with an amplitude in direct proportion to an amplitude of the second data signal to the light-emitting device according to the first signal and the another first data signal.

In some embodiments, the control circuit includes a current monitoring sub-circuit and an output sub-circuit. The current monitoring sub-circuit is coupled to the at least one pixel circuit. The output sub-circuit is coupled to the at least one pixel circuit, the second data signal terminal and the current monitoring sub-circuit. The current monitoring sub-circuit is configured to monitor the first driving signal, and output a third signal according to the first driving signal. The output sub-circuit is configured to output the another first data signal to the pixel circuit according to the third signal from the current monitoring sub-circuit and the second data signal.

In some embodiments, the current monitoring sub-circuit includes a resistor and a first amplifier. A first end of the resistor is coupled to the at least one pixel circuit. A first input terminal of the first amplifier is coupled to the first end of the resistor, and a second input terminal of the first amplifier is coupled to a second end of the resistor. The output sub-circuit includes a second amplifier. A first input terminal of the second amplifier is coupled to an output terminal of the first amplifier, a second input terminal of the second amplifier is coupled to the second data signal terminal, and an output terminal of the second amplifier is coupled to the at least one pixel circuit.

In some embodiments, the control circuit further includes a voltage follower sub-circuit. The voltage follower sub-circuit is coupled to a first signal terminal, the second signal terminal and the at least one pixel circuit. The voltage follower sub-circuit is configured to provide the first signal having a same amplitude as the second signal to the pixel circuit according to a previous first signal from the first signal terminal and the second signal from the second signal terminal.

In some embodiments, the voltage follower sub-circuit includes a third amplifier. A first input terminal of the third amplifier is coupled to the first signal terminal, a second input terminal of the third amplifier is coupled to the second signal terminal, and an output terminal of the third amplifier is coupled to the at least one pixel circuit.

In some embodiments, the first signal terminal and the second signal terminal are included in the driving circuit, and the first signal terminal is coupled to the second signal terminal.

In some embodiments, the driving circuit further includes at least one selection circuit coupled to the control circuit. A selection circuit in the at least one selection circuit is coupled to at least the scan signal terminal, the voltage follower sub-circuit and the second signal terminal. The selection circuit is configured to transmit the second signal from the second signal terminal to the voltage follower sub-circuit in response to the scan signal received at the scan signal terminal.

In some embodiments, the selection circuit includes a first transistor. A control electrode of the first transistor is coupled to the scan signal terminal, a first electrode of the first transistor is coupled to the second signal terminal, and a second electrode of the first transistor is coupled to the voltage follower sub-circuit.

In some embodiments, the selection circuit is further coupled to the first signal terminal. The selection circuit is further configured to transmit the previous first signal from the first signal terminal to the voltage follower sub-circuit in response to the scan signal received at the scan signal terminal.

In some embodiments, the selection circuit includes a first transistor and a second transistor. A control electrode of the first transistor is coupled to the scan signal terminal, a first electrode of the first transistor is coupled to the second signal terminal, and a second electrode of the first transistor is coupled to the voltage follower sub-circuit. A control electrode of the second transistor is coupled to the scan signal terminal, a first electrode of the second transistor is coupled to the first signal terminal, and a second electrode of the second transistor is coupled to the voltage follower sub-circuit.

In some embodiments, the at least one pixel circuit includes pixel circuits, and the at least one selection circuit includes selection circuits, and each selection circuit is coupled to a respective one of the pixel circuits.

In some embodiments, the pixel circuit includes a driving sub-circuit, a writing sub-circuit and a light-emitting control sub-circuit. The writing sub-circuit is coupled to the scan signal terminal, the control circuit and the driving sub-circuit, and the writing sub-circuit is configured to transmit the another first data signal from the control circuit to the driving sub-circuit in response to the scan signal received at the scan signal terminal, and transmit the first signal to the driving sub-circuit in response to the scan signal received at the scan signal terminal. The light-emitting control sub-circuit is coupled to the enable signal terminal, the second signal terminal and the driving sub-circuit, and the light-emitting control sub-circuit is configured to transmit the second signal from the second signal terminal to the driving sub-circuit in response to the enable signal received at the enable signal terminal. The driving sub-circuit is configured to be coupled to the light-emitting device, and is configured to provide the another first driving signal to the light-emitting device according to the another first data signal and the first signal, and provide the second driving signal to the light-emitting device according to the another first data signal and the second signal.

In some embodiments, the driving circuit includes a driving transistor and a capacitor. A control electrode of the driving transistor is coupled to a first electrode of the capacitor, a first electrode of the driving transistor is coupled to a second electrode of the capacitor, and a second electrode of the driving transistor is configured to be coupled to the light-emitting device.

In some embodiments, the writing sub-circuit includes a third transistor and a fourth transistor. A control electrode of the third transistor is coupled to the scan signal terminal, a first electrode of the third transistor is coupled to the first data signal terminal, and a second electrode of the third transistor is coupled to the driving sub-circuit. A control electrode of the fourth transistor is coupled to the scan signal terminal, a first electrode of the fourth transistor is coupled to the control circuit, and a second electrode of the fourth transistor is coupled to the driving sub-circuit.

In some embodiments, the light-emitting control sub-circuit includes a fifth transistor. A control electrode of the fifth transistor is coupled to the enable signal terminal, a first electrode of the fifth transistor is coupled to the second signal terminal, and a second electrode of the fifth transistor is coupled to the driving sub-circuit.

In another aspect, a display panel is provided. The display panel includes the driving circuit as described in any of the above embodiments and a plurality of light-emitting devices coupled to the driving circuit.

In yet another aspect, a display device is provided. The display device includes the display panel as described in the above embodiment.

In yet another aspect, a driving method of a driving circuit is provided. The driving circuit includes at least one pixel circuit and a control circuit. The driving method includes: writing, by each pixel circuit, a first data signal received at a first data signal terminal in response to a scan signal received at a scan signal terminal, generating, by the pixel circuit, a first driving signal according to a first signal and the first data signal; and monitoring, by the control circuit, the first driving signal; providing, by the control circuit, another first data signal to the pixel circuit according to the first driving signal and a second data signal received at a second data signal terminal; providing, by the pixel circuit, another first driving signal to a light-emitting device according to the first signal and the another first data signal; and in response to an enable signal received at an enable signal terminal, providing, by the pixel circuit, a second driving signal to the light-emitting device according to a second signal received at a second signal terminal and the another first data signal, wherein an amplitude of the another first driving signal and an amplitude of the second driving signal are approximately equal.

In some embodiments, the first signal and the second signal are approximately identical.

BRIEF DESCRIPTION OF THE DRAWINGS

In order to describe technical solutions in the present disclosure more clearly, accompanying drawings to be used in some embodiments of the present disclosure will be introduced briefly. However, the accompanying drawings to be described below are merely accompanying drawings of some embodiments of the present disclosure, and a person of ordinary skill in the art can obtain other drawings according to these drawings. In addition, the accompanying drawings in the following description can be regarded as schematic diagrams, and are not limitations on actual dimensions of products, actual processes of methods and actual timings of signals involved in the embodiments of the present disclosure.

DETAILED DESCRIPTION

Figure 1:
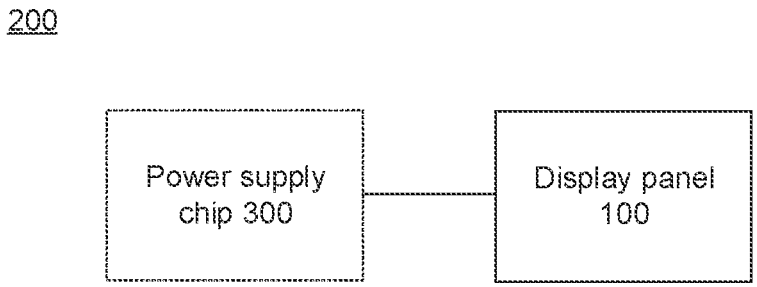
FIG. 1 is a block diagram of a display device, in accordance with some embodiments.

Technical solutions in some embodiments of the present disclosure will be described clearly and completely with reference to the accompanying drawings below. However, the described embodiments are merely some but not all embodiments of the present disclosure. All other embodiments obtained on a basis of the embodiments of the present disclosure by a person of ordinary skill in the art shah be included in the protection scope of the present disclosure.

Unless the context requires otherwise, throughout the description and the claims, the term "comprise" and other forms thereof such as the third-person singular form "comprises" and the present participle form "comprising" are construed as an open and inclusive meaning, i.e., "including, but not limited to." In the description, the terms "one embodiment", "some embodiments", "exemplary embodiments", "example", "specific example", "some examples" and the like are intended to indicate that specific features, structures, materials, or characteristics related to the embodiment(s) or example(s) are included in at least one embodiment or example of the present disclosure. Schematic representations of the above terms do not necessarily refer to the same embodiment(s) or example(s). In addition, the specific features, structures, materials, or characteristics described herein may be included in any one or more embodiments or examples in any suitable manner.

Hereinafter, the terms "first" and "second" are only used for descriptive purposes and are not to be construed as indicating or implying the relative importance or implicitly indicating the number of indicated technical features. Thus, features defined with "first", "second" may explicitly or implicitly include one or more of the features. In the description of the embodiments of the present disclosure, "a plurality of", "the plurality of" and "multiple" all mean two or more unless otherwise specified.

In the description of some embodiments, terms "coupled", "connected" and their derivatives may be used. For example, the term "connected" may be used in the description of some embodiments to indicate that two or more components are in direct physical or electric contact with each other. As another example, the term "coupled" may be used in the description of some embodiments to indicate that two or more components are in direct physical or electric contact. However, the term "coupled" or "connected" may also mean that two or more components are not in direct contact with each other, but still cooperate or interact with each other. The embodiments disclosed herein are not necessarily limited to the contents herein.

The use of the phrase "applicable to" or "configured to" herein means an open and inclusive language, which does not exclude devices that are applicable to or configured to perform additional tasks or steps.

The term "about" or "approximately" as used herein includes a stated value and an average value within an acceptable range of deviation of a particular value. The acceptable range of deviation is determined by a person of ordinary skill in the art in view of the measurement in question and the error associated with the measurement of a specific amount (i.e., the limitations of the measurement system).

Some embodiments of the present disclosure provide a display device. In some examples, the display device may be any device that may display an image whether moving (such as a video) or fixed (such as a static image), and whether literal or graphical. For example, the display device may be one of a variety of electronic devices, and the described embodiments may be implemented in or associated with a variety of electronic devices. The variety of electronic devices may include (but not limited to), for example, mobile telephones, wireless devices, portable android devices (PAD), hand-held or portable computers, global positioning system (GPS) receivers/navigators, cameras, MPEG-4 Part 14 (MN) video players, video cameras, game consoles, watches, clocks, calculators, TV monitors, flat-panel displays, computer monitors, car displays (e.g., odometer displays), navigators, cockpit controllers and/or displays, camera view displays (e.g., display of rear view camera in vehicles), electronic photos, electronic billboards or signs, projectors, architectural structures, and packagings and aesthetic structures (e.g., displays for displaying an image of a piece of jewelry), etc. Embodiments of the present disclosure do not particularly limit a specific form of the display device.

Figure 2:
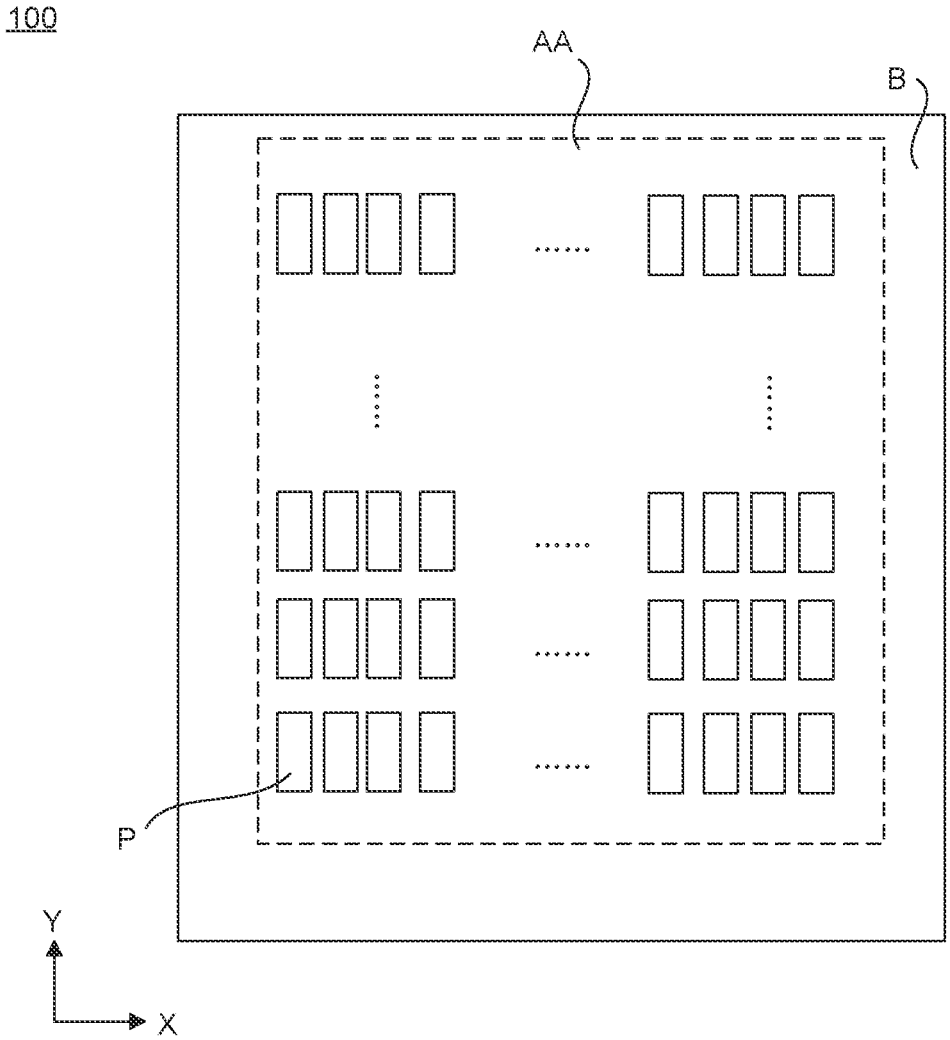
FIG. 2 is a schematic diagram of a display panel, in accordance with some embodiments.

In some embodiments, as shown in FIG. 1, the display device 200 includes a display panel 100. As shown in FIG. 2, the display panel 100 may have an active area (AA) and a peripheral area B. The peripheral area B may be located on at least one side of the AA.

As shown in FIG. 2, the display panel 100 includes a plurality of sub-pixels P disposed in the AA. In some examples, the plurality of sub-pixels P are arranged in an array. For example, sub-pixels P arranged in a line along an X direction (i.e., a horizontal direction in FIG. 2) are referred to as sub-pixels in a same row, and sub-pixels P arranged in a line along a Y direction (i.e., a vertical direction in FIG. 2) are referred to as sub-pixels in a same column. In some examples, the plurality of sub-pixels P include sub-pixels of a first color, sub-pixels of a second color, and sub-pixels of a third color. For example, the first color, the second color, and the third color are three primary colors, e.g., red, green, and blue, respectively. That is, the plurality of sub-pixels P include red sub-pixels, green sub-pixels, and blue sub-pixels.

Figure 3:
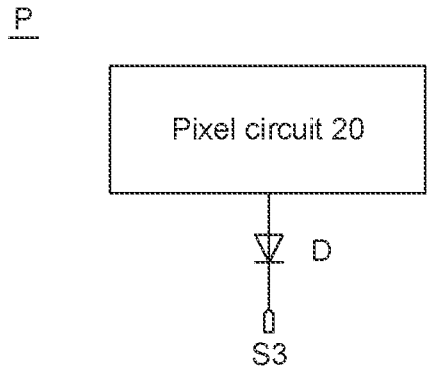
FIG. 3 is a schematic diagram of a sub-pixel, in accordance with some embodiments.

In some embodiments, the display panel 100 includes light-emitting devices. In some examples, referring to FIG. 3, the sub-pixel P includes a light-emitting device D. The light-emitting device D may be a current-driven device. For example, the light-emitting device D adopts a current-type light-emitting diode, such as a micro light-emitting diode (Micro LED), a mini light-emitting diode (Mini LED), an organic light-emitting diode (OLEO), or a quantum dot light-emitting diode (QLED).

In some embodiments, the display panel 100 further includes pixel circuits. In some examples, referring to FIG. 3, the sub-pixel P further includes a pixel circuit 20 coupled to the light-emitting device D. The pixel circuit 20 may be configured to drive the light-emitting device D to operate. For example, a first electrode of the light-emitting device D is coupled to the pixel circuit 20, and a second electrode of the light-emitting device D is coupled to a third signal terminal S3. The first electrode and the second electrode of the light-emitting device D may be an anode and a cathode, respectively. The third signal terminal S3 may be configured to provide a direct current (DC) voltage, such as a DC low-level voltage.

In some embodiments, referring to FIG. 1, the display device 200 further includes a power supply chip 300 coupled to the display panel 100. The power supply chip 300 is, for example, a power management integrated circuit (PMIC). The power supply chip 300 may provide power supply voltages to the display panel 100. For example, the power supply voltages include a first power supply voltage and a second power supply voltage. For example, the first power supply voltage is a high-level power supply voltage, and the second power supply voltage is a low-level power supply voltage. The pixel circuit 20 may receive the high-level power supply voltage, and the light-emitting device D may receive the low-level power supply voltage.

The pixel circuit 20 may be composed of two or more transistors and other electronic devices (e.g., a capacitor or the like). The pixel circuit 20 provides a driving signal to the light-emitting device D to drive the light-emitting device D to emit light. The brightness of the light-emitting device D may depend on a magnitude of the driving signal.

In the production process of the display device, there may be a deviation in the performance of the transistors in the pixel circuits due to the uncertainty of the production process. For example, threshold voltages and transfer characteristic curves of transistors in different pixel circuits are different. For example, a threshold voltage of a transistor may change at different stresses or temperatures, that is, the threshold voltage may drift at different stresses or temperatures. Therefore, in a process of the pixel circuit driving the light-emitting device to operate, a driving signal provided by the pixel circuit to the light-emitting device may be affected, so that the brightness of the light-emitting device may be deviated from preset brightness, thereby affecting the uniformity of the display brightness of the display panel.

Figure 4:
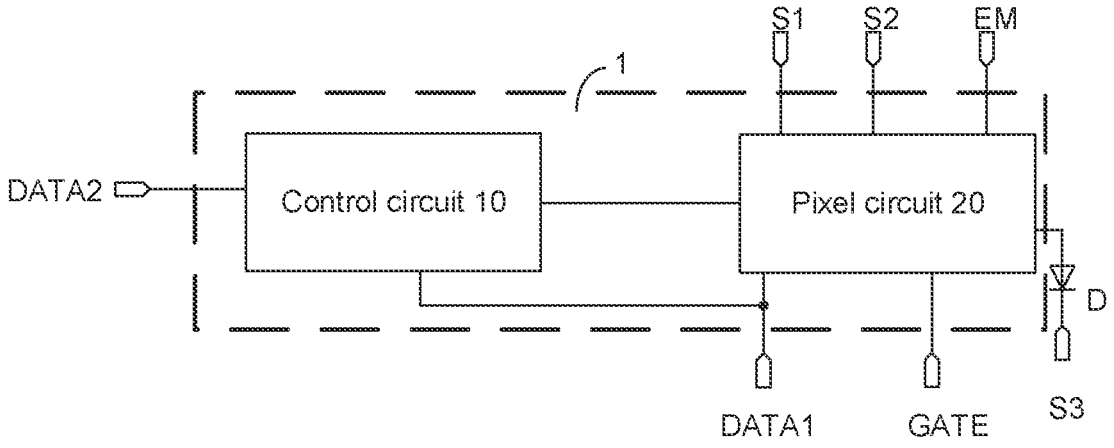
FIG. 4 is a block diagram of a driving circuit; in accordance with some embodiments.
Figure 14:
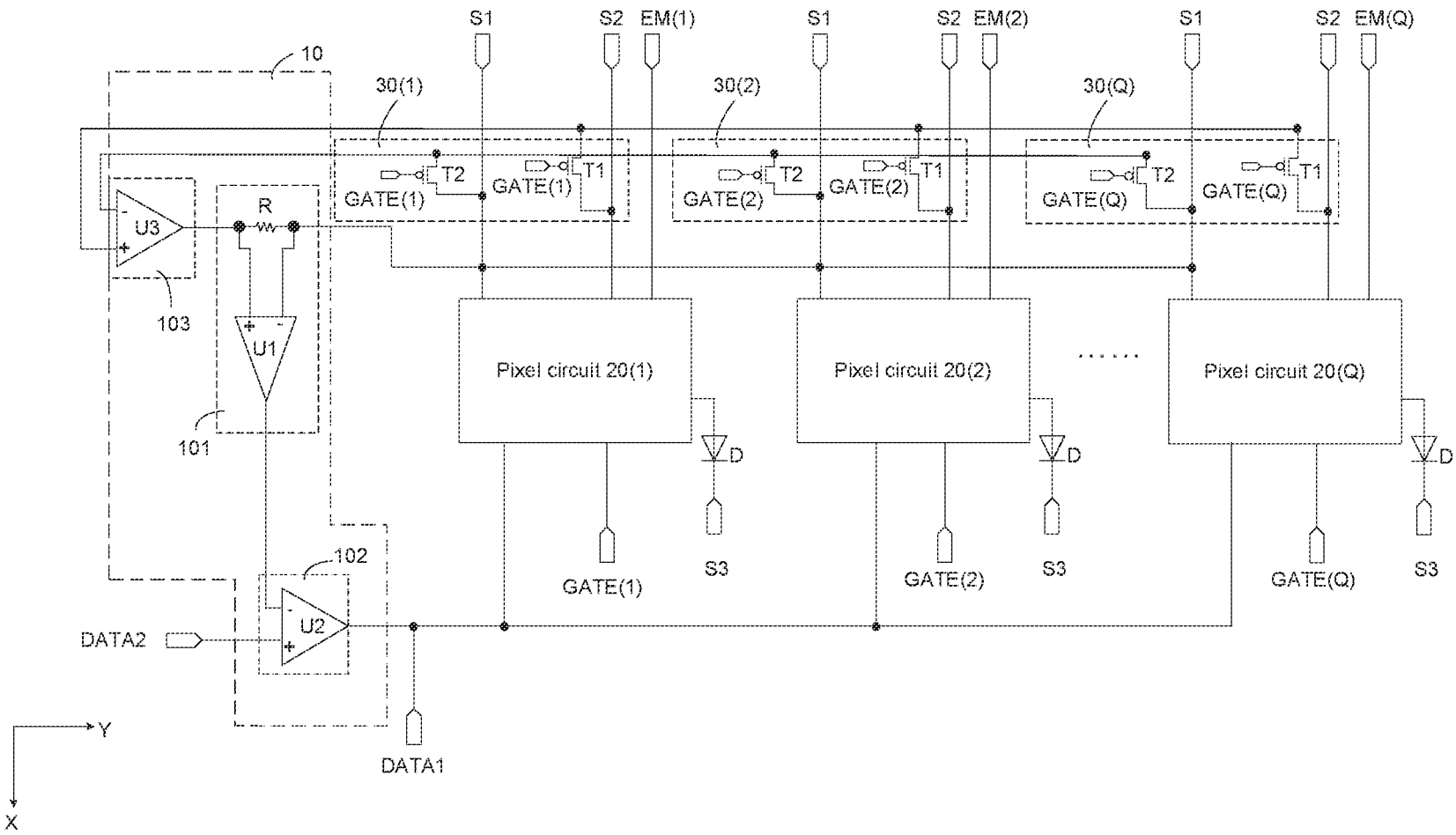
FIG. 14 is a schematic diagram of yet another driving circuit, in accordance with some embodiments.

Some embodiments of the present disclosure provide a driving circuit. As shown in FIGS. 4 and 14, the driving circuit 1 includes a control circuit 10 and at least one pixel circuit 20. Each pixel circuit 20 is coupled to a scan signal terminal GATE, a first data signal terminal DATA1, a second signal terminal S2, an enable signal terminal EM, and a light-emitting device D. The control circuit 10 is coupled to a second data signal terminal DATA2 and the at least one pixel circuit 20. As shown in FIG. 4, the pixel circuit 20 may be further coupled to a first signal terminal S1. As shown in FIG. 14, the control circuit 10 may be further coupled to the first signal terminal S1 and the first data signal terminal DATA1.

In the embodiment of the present disclosure, each of terminals (e.g., the scan signal terminal GATE, the first data signal terminal DATA1, the first signal terminal S1, the second signal terminal S2, and the enable signal terminal EM) is a point at which a connection may be made in a circuit. For example, the terminal may be a junction point of an electrical connection in a circuit diagram. That is, the terminal is a node equivalent to the junction point of the electrical connection in the circuit diagram.

For example, as shown in FIGS. 2 and 4, the control circuit 10 may be located in the peripheral area B of the display panel 100. For example, the control circuit 10 is disposed on a base substrate of the display panel 100. Alternatively, the control circuit 10 is included in a source driver (Source IC) bonded to the base substrate of the display panel 100. The at least one pixel circuit 20 is located in the AA of the display panel 100.

Each pixel circuit 20 is configured to: write a first data signal received at the first data signal terminal DATA1 in response to a scan signal received at the scan signal terminal GATE; and generate a first driving signal according to a first signal and the first data signal. The control circuit 10 is configured to monitor the first driving signal, and provide another first data signal to the pixel circuit 20 according to the first driving signal and a second data signal received at the second data signal terminal S2. The pixel circuit 20 is further configured to: provide another first driving signal to the light-emitting device D according to the first signal and the another first data signal; and in response to an enable signal received at the enable signal terminal EM, provide a second driving signal to the light-emitting device according to a second signal received at the second signal terminal S2 and the another first data signal. An amplitude of the another first driving signal and an amplitude of the second driving signal are equal or approximately equal.

In some examples, the first signal and the second signal are the same or approximately the same. That is, the first signal received by the pixel circuit 20 from the first signal terminal S1 is the same or approximately the same as the second signal received by the pixel circuit 20 from the second signal terminal S2, and an amplitude of the first signal may be the same or approximately the same as an amplitude of the second signal. For example, the first signal and the second signal are voltage signals which have the same or approximately the same voltage.

For example, the second signal received by the pixel circuit 20 from the second signal terminal S2 is a DC signal, such as a DC high-level voltage (e.g., the high-level power supply voltage mentioned above). For example, the first signal received by the pixel circuit 20 from the first signal terminal S1 is also a DC signal, such as a DC high-level voltage.

Figure 18A:
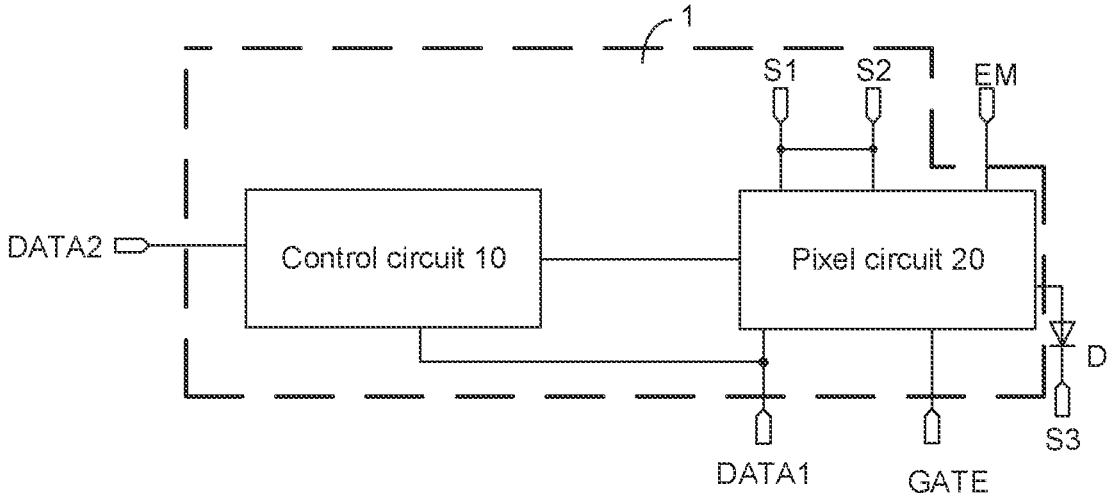
FIG. 18A is a block diagram of yet another driving circuit, in accordance with some embodiments.
Figure 18B:
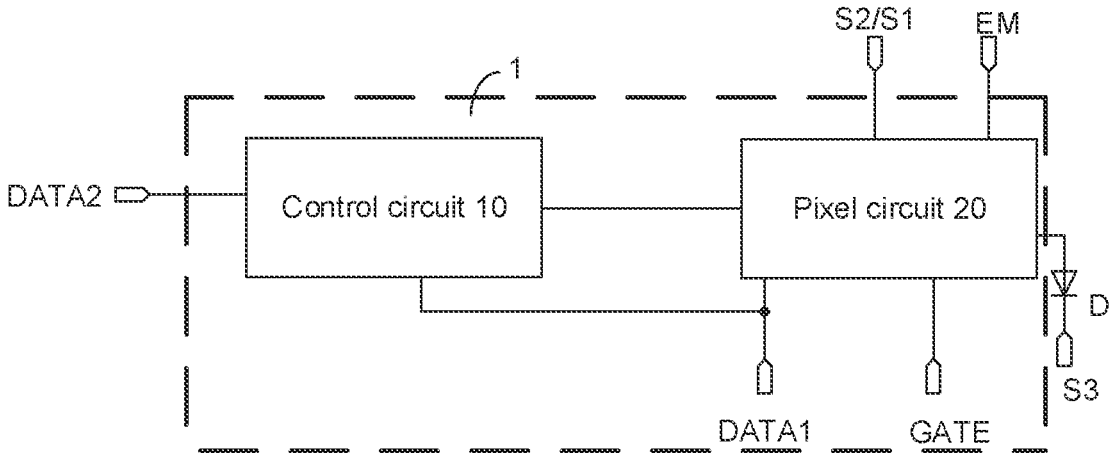
FIG. 18B is a block diagram of yet another driving circuit, in accordance with some embodiments.

For example, referring to FIG. 18A, the first signal terminal S1 is coupled to the second signal terminal S2. In this case, the first signal transmitted by the first signal terminal S1 and the second signal transmitted by the second signal terminal S2 are a same signal. That is, the amplitude of the first signal and the amplitude of the second signal are the same or approximately the same. For example, referring to FIG. 18A, the first signal terminal S1 and the second signal terminal S2 are directly connected. Alternatively, referring to FIG. 18B, the first signal terminal S1 and the second signal terminal S2 are a same signal terminal.

In the driving circuit 1 provided by the embodiments of the present disclosure, the pixel circuit 20 generates a first driving signal, which is fed back to the control circuit 10, according to a first data signal and a first signal, the control circuit 10 outputs another first data signal to the pixel circuit 20 according to the first driving signal and a second data signal, and the pixel circuit 20 generates another first driving signal according to the another first data signal and the first signal, and generates a second driving signal according to the another first data signal and a second signal. An amplitude of the second driving signal is the same or approximately the same as an amplitude of the another first driving signal.

In this manner, in a process of the pixel circuit 20 generating the another first driving signal, the pixel circuit 20 and the control circuit 10 may form a conductive path, and the control circuit 10 outputs the another first data signal according to the fed back first driving signal and the second data signal. In this case, the amplitude of the another first driving signal output by the pixel circuit 20 is related to the amplitude of the second data signal. Therefore, by controlling the magnitude of the second data signal, the driving circuit 1 may control the magnitude of the another first data signal, further control the magnitude of the another first driving signal, and correspondingly control the magnitude of the second driving signal, so that the amplitude of the another first driving signal and the amplitude of the second driving signal are both related to the amplitude of the second data signal. Moreover, the driving signals (i.e., the another first driving signal and the second driving signal) received by the light-emitting device D have the same or approximately the same amplitude, so that the brightness of the light-emitting device D may tend to be stable. Therefore, when the light-emitting device D is working, the amplitude of the another first driving signal and the amplitude of the second driving signal passing through the light-emitting device D may be controlled only by the amplitude of the second data signal, so as to avoid a problem of non-uniform display of the display panel caused by changes in performance of transistors in different regions of the display panel.

Moreover, there is no need to set complicated compensation algorithms in the display device in the embodiments of the present disclosure or arrange compensation circuits in the pixel circuits to compensate for the threshold voltage or consistency of the transistors in the sub-pixels, which simplifies the design of the product. In addition, it is also possible to avoid a problem of non-uniform display of the display panel caused by a charging rate of each sub-pixel getting lower due to the charging time of the sub-pixel being shortened since resolution and frame rate of the display panel are improved.

In some examples, the pixel circuit 20 is configured to provide the another first driving signal with an amplitude in direct proportion to an amplitude of the second data signal to the light-emitting device D according to the first signal and the another first data signal. That is, as the amplitude of the second data signal increases, the amplitude of the another first driving signal increases correspondingly, and as the amplitude of the second data signal decreases, the amplitude of the another first driving signal decreases correspondingly. In this way, the amplitude of the another first driving signal is related to the amplitude of the second data signal, and the amplitude of the second driving signal is equal or approximately equal to the amplitude of the another first driving signal. Therefore, the amplitude of the second driving signal is also related to the amplitude of the second data signal. For example, the magnitude of a first driving current and the magnitude of a second driving current may be controlled by the magnitude of the second data signal. In this way, it may avoid a problem that the uniformity of the display panel is influenced by the difference of the driving signals received by the light-emitting devices D caused by deviation in performance of transistors in different regions of the display panel.

Figure 5:
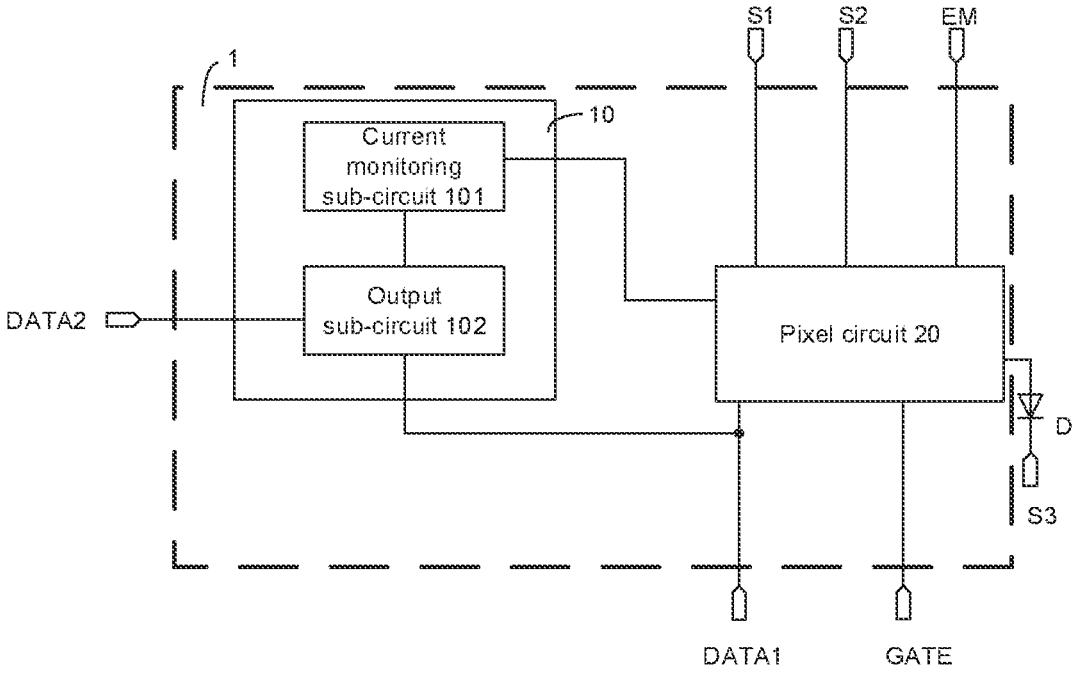
FIG. 5 is a block diagram of another driving circuit, in accordance with some embodiments.

For example, as shown in FIGS. 5 and 14, the control circuit 10 includes a current monitoring sub-circuit 101 and an output sub-circuit 102. The current monitoring sub-circuit 101 is coupled to the at least one pixel circuit 20. The output sub-circuit 102 is coupled to the second data signal terminal DATA2, the current monitoring sub-circuit 101 and the at least one pixel circuit 20. As shown in FIG. 14, the current monitoring sub-circuit 101 may be further coupled to the first signal terminal S1, and the output sub-circuit 102 may be further coupled to the first data signal terminal DATA1.

The current monitoring sub-circuit 101 is configured to monitor the first driving signal, and output a third signal to the output sub-circuit 102 according to the first driving signal. For example, an amplitude of the third signal is in direct proportional to the amplitude of the first driving signal (e.g., the first driving current).

The output sub-circuit 102 is configured to output the another first data signal to the pixel circuit 20 according to the third signal from the current monitoring sub-circuit 101 and the second data signal received at the second data signal terminal DATA2.

Figure 6:
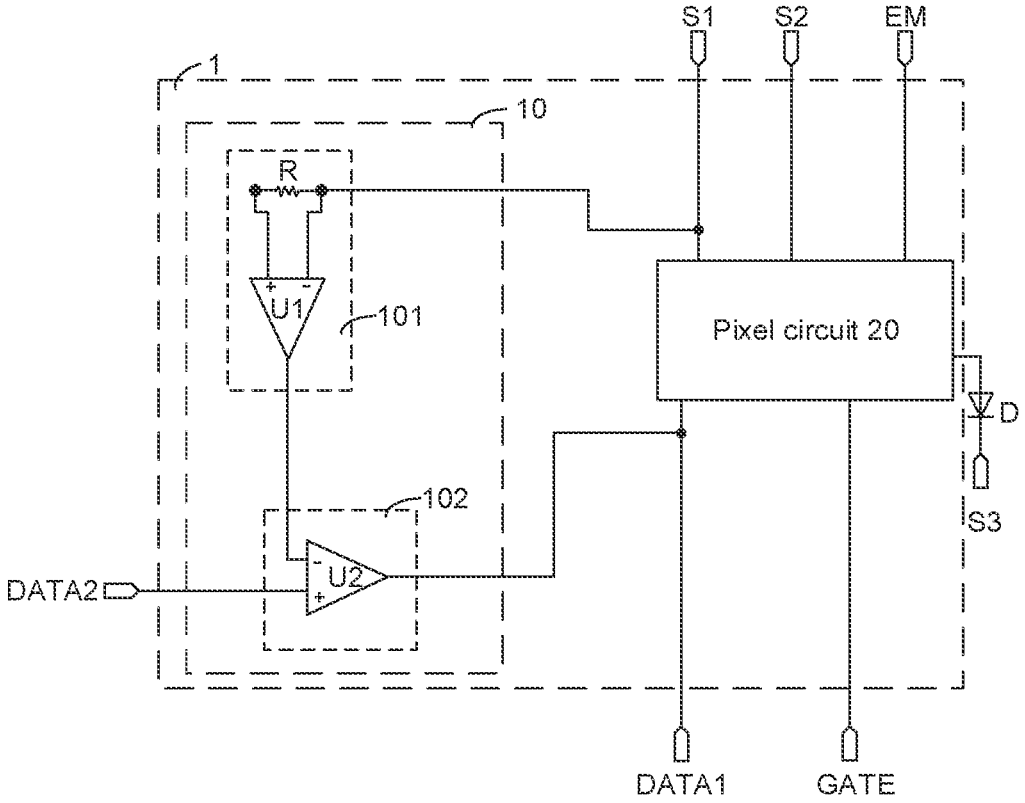
FIG. 6 is a schematic diagram of yet another driving circuit, in accordance with some embodiments.

In some examples, as shown in FIGS. 6 and 14, the current monitoring sub-circuit 101 includes a resistor R and a first amplifier U1. For example, the first amplifier U1 is an operational amplifier. A first end of the resistor R is coupled to the at least one pixel circuit 20. The first end of the resistor R may be further coupled to the first signal terminal S1. A first input terminal (i.e., an inverting input) of the first amplifier U1 is coupled to the first end of the resistor R, and a second input terminal (i.e., a non-inverting input) of the first amplifier U1 is coupled to a second end of the resistor R. For example, the resistor R may convert the first driving signal, i.e., the first driving current, into a voltage, and the first amplifier U1 outputs a third signal according to the converted voltage.

The output sub-circuit 102 includes a second amplifier U2. For example, the second amplifier U2 is an operational amplifier. A first input terminal (i.e., an inverting input) of the second amplifier U2 is coupled to an output terminal of the first amplifier U1, a second input terminal (i.e., a non-inverting input) of the second amplifier U2 is coupled to the second data signal terminal DATA2, and an output terminal of the second amplifier U2 is coupled to the at least one pixel circuit 20. The output terminal of the second amplifier U2 may be further coupled to the first data signal terminal DATA1. For example, the second amplifier U2 outputs the another first data signal to the pixel circuit 20 according to the third signal and the second data signal.

For example, since the current monitoring sub-circuit 101, the output sub-circuit 102 and the pixel circuit 20 constitute a depth negative feedback loop related to the current, a virtual circuit exists between the first input terminal and the second input terminal of the second amplifier U2. That is, a potential of the first input terminal of the second amplifier U2 is equal to a potential of the second input terminal of the second amplifier U2.

For example, if a current passing through the resistor R in the current monitoring sub-circuit 101 is represented as I, a resistance of the resistor R is represented as $R_S$, and an amplitude (i.e., a voltage) of the third signal output from the output terminal of the first amplifier U1 is represented as $V_{current}$, then $V_{current}=\alpha\times I\times R_S$, where $\alpha$ is the amplification factor of the first amplifier U1 In addition, an amplitude (i.e., a voltage) of the second data signal received by the second input terminal of the second amplifier U2 is represented as $V_{data2}$. Since a virtual short exists between the first input terminal and the second input terminal of the second amplifier U2, that is, the amplitude $V_{data2}$ of the second data signal received by the second input terminal of the second amplifier U2 is equal to the amplitude $V_{current}$ of the third signal received by the first input terminal of the second amplifier U2 from the first amplifier U1, That is, $V_{current}=V_{data2}$. Therefore, according to the formula $V_{current}=\alpha\times I\times R_S$, it can be obtained that $I=V_{data2}/\alpha\cdot R_S$, that is, the current passing through the resistor R in the current monitoring sub-circuit 101 is $V_{data2}/\alpha\cdot R_S$.

In this case, since the current passing through the resistor R is equal to the amplitude of the first driving signal (i.e., the first driving current), the amplitude of the first driving signal is in direct proportion to the amplitude of the second data signal. In this way, by controlling the amplitude of the second data signal and selecting the amplification factor of the first amplifier U1 the amplitude of the another first driving signal and the amplitude of the second driving signal may be controlled, so as to control the brightness of the light-emitting device D. As a result, the magnitudes of the another first driving signal and the second driving signal received by the light-emitting device are independent of the threshold voltage of the transistor in the pixel circuit 20, thereby avoiding a problem of non-uniform brightness of the light-emitting device D of the display panel due to the threshold voltage of the transistor in the pixel circuit 20.

Figure 7:
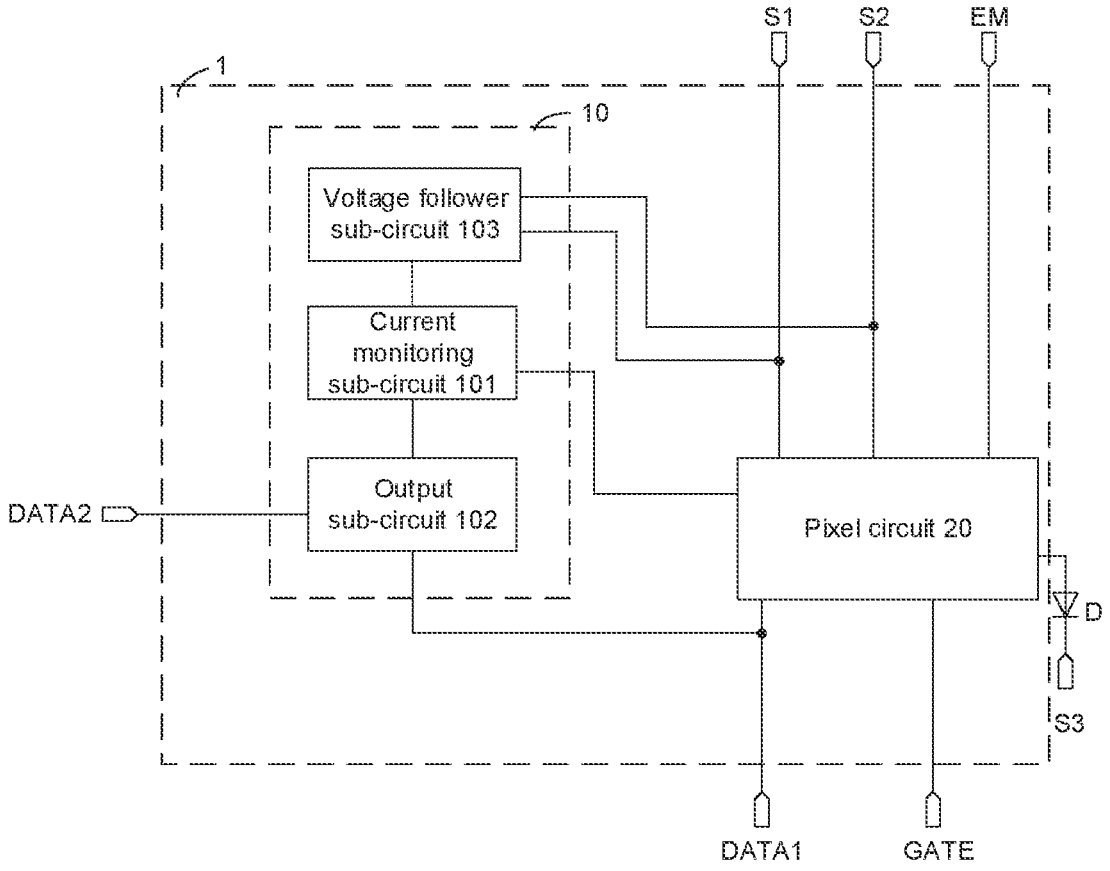
FIG. 7 is a block diagram of yet another driving circuit, in accordance with some embodiments.

In some embodiments, as shown in FIG. 7, the control circuit 10 further includes a voltage follower sub-circuit 103. The voltage follower sub-circuit 103 is coupled to the first signal terminal S1, the second signal terminal S2 and the at least one pixel circuit 20.

The voltage follower sub-circuit 103 is configured to provide the first signal having a same amplitude as the second signal to the pixel circuit 20 according to a previous first signal from the first signal terminal S1 and the second signal from the second signal terminal S2.

In this case, the first signal received by the pixel circuit 20 and the second signal received by the pixel circuit 20 have the same amplitude. For example, the voltage of the first signal received by the pixel circuit 20 is equal to the voltage of the second signal received by the pixel circuit 20. For example, the first signal terminal S1 is coupled to the second signal terminal S2 through the voltage follower sub-circuit 103.

It can be understood that, in a case where the pixel circuit 20 is switched from a state of receiving the first signal from the first signal terminal S1 to a state of receiving the second signal from the second signal terminal S2, since wiring manners of the first signal terminal S1 and the second signal terminal S2 are different, the amplitude of the second signal input to the second signal terminal S2 is different from the first signal input to the first signal terminal S1, so that the driving signal passing through the light-emitting device D may also be changed. However, in the embodiments of the present disclosure, through the voltage follower sub-circuit 103, the first signal actually received by the pixel circuit 20 and the second signal received by the pixel circuit 20 have the same amplitude. Therefore, it is possible to avoid a problem that the luminance of the light-emitting device D is non-uniform due to a difference between the amplitude of the another first driving signal and the amplitude of the second driving signal provided by the pixel circuit 20 to the light-emitting device in the case where the pixel circuit 20 being switched from the state of receiving the first signal from the first signal terminal S1 to the state of receiving the second signal from the second signal terminal S2.

Figure 8:
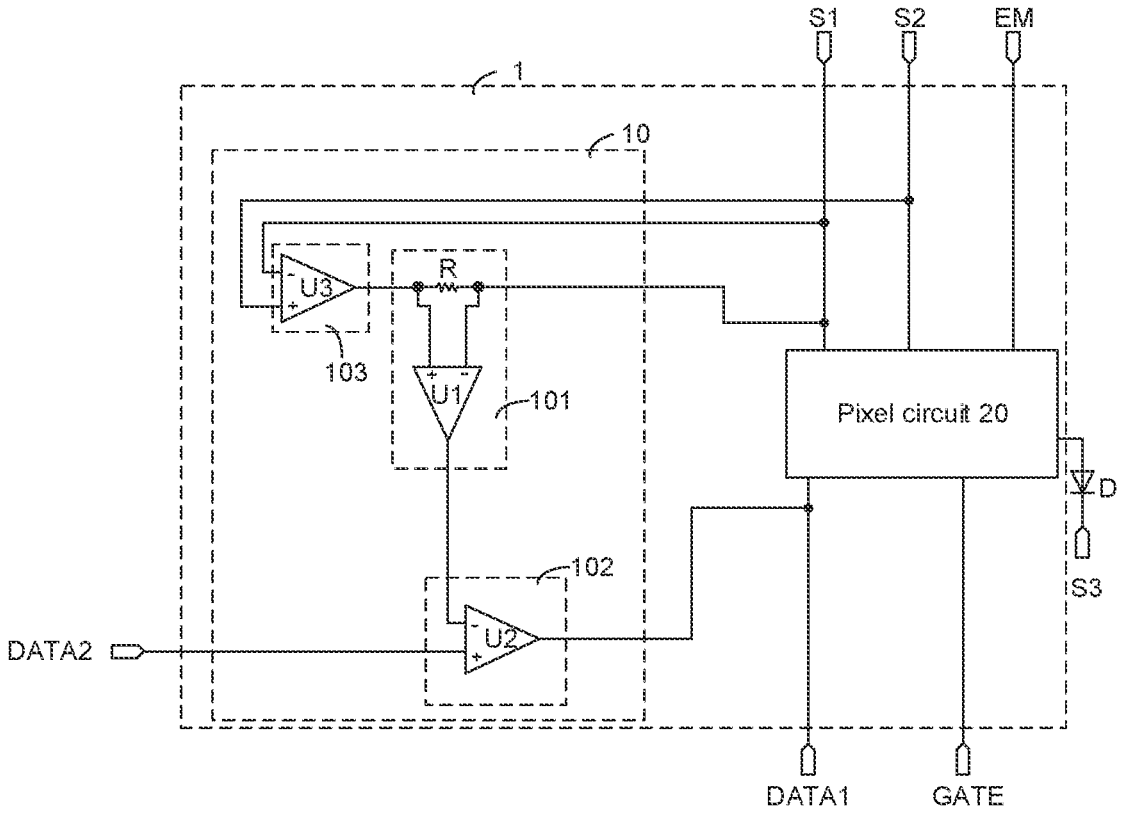
FIG. 8 is a schematic diagram of yet another driving circuit, in accordance with some embodiments.

For example, as shown in FIG. 8, the voltage follower sub-circuit 103 includes a third amplifier U3. A first input terminal (i.e., an inverting input) of the third amplifier U3 is coupled to the first signal terminal S1, a second input terminal (i.e., a non-inverting input) of the third amplifier U3 is coupled to the second signal terminal S2, and an output terminal of the third amplifier U3 is coupled to the first signal terminal S1 and the pixel circuit 20. For example, the output terminal of the third amplifier U3 is coupled to the second end of the resistor R. In this way, the signal output by the third amplifier U3 may be transmitted to the pixel circuit 20 through the resistor R, so that the amplitude (i.e., the voltage) of the first signal received by the pixel circuit 20 is equal to the amplitude (i.e., the voltage) of the second signal received by the pixel circuit 20.

For example, referring to FIG. 8, the current monitoring sub-circuit 101 is coupled to the pixel circuit 20 and the first signal terminal S1, the voltage follower sub-circuit 103 is coupled to the current monitoring sub-circuit 101, and the voltage follower sub-circuit 103 is coupled to the pixel circuit 20 through the current monitoring sub-circuit 101. For example, the output terminal of the third amplifier U3 is coupled to the current monitoring sub-circuit 101. For example, the output terminal of the third amplifier U3 is coupled to the second end of the resistor R, and the first end of the resistor R is coupled to pixel circuit 20. In this way, the output terminal of the third amplifier U3 is coupled to the pixel circuit 20 through the resistor R. In this case, the signal output by the voltage follower sub-circuit 103 will pass through the current monitoring sub-circuit 101 and reach the pixel circuit 20, so that the first signal received by the pixel circuit 20 and the second signal received by the pixel circuit 20 have the same amplitude.

Figure 9:
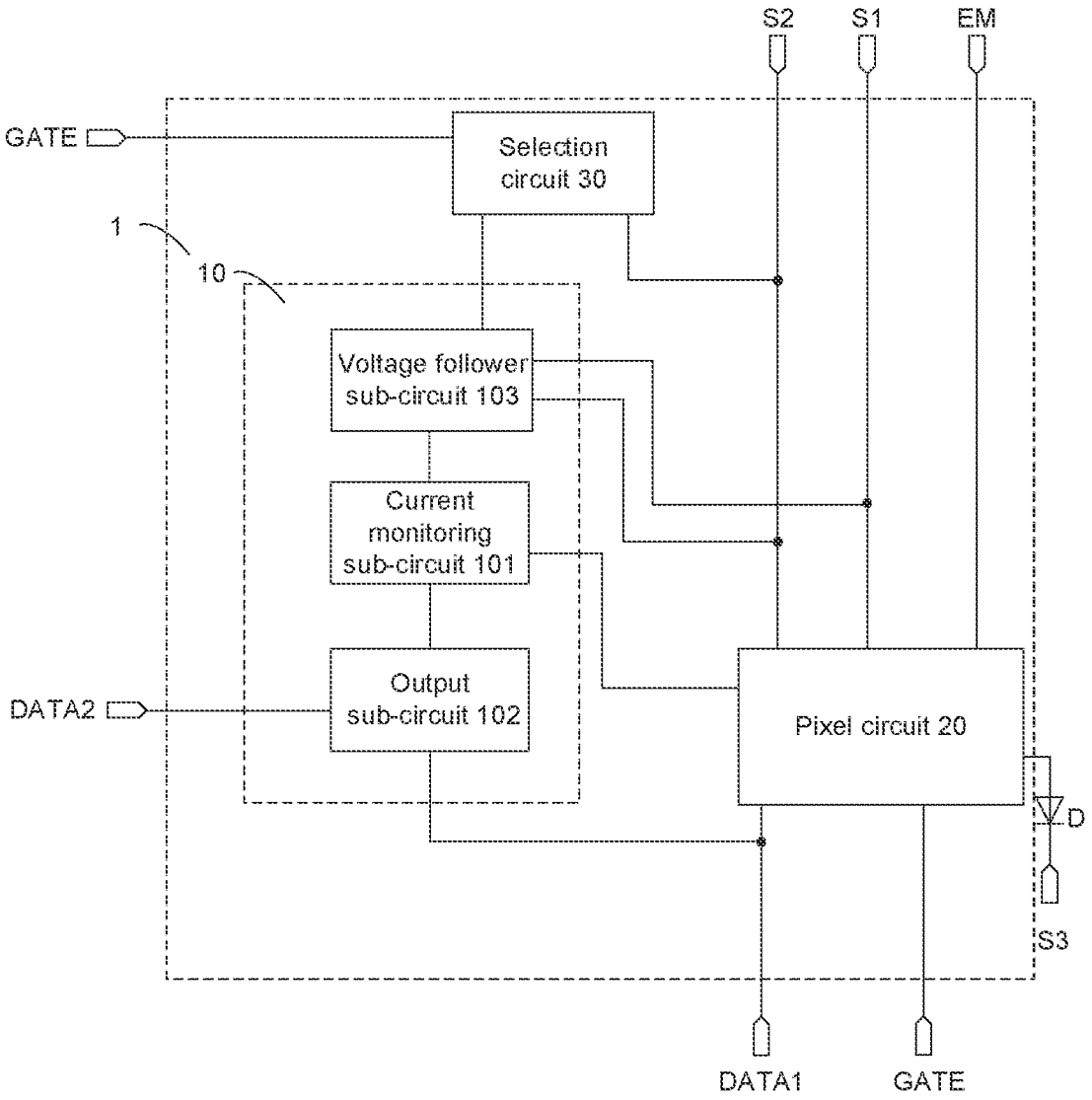
FIG. 9 is a block diagram of yet another driving circuit, in accordance with some embodiments.

In some embodiments, as shown in FIGS. 9 and 14, the driving circuit 1 further includes at least one selection circuit 30 coupled to the control circuit 10. A selection circuit 30 is coupled to at least the scan signal terminal GATE, the voltage follower sub-circuit 103 and the second signal terminal S2. The selection circuit 30 is configured to transmit the second signal from the second signal terminal S2 to the voltage follower sub-circuit 103 in response to the scan signal received at the scan signal terminal GATE.

Figure 10:
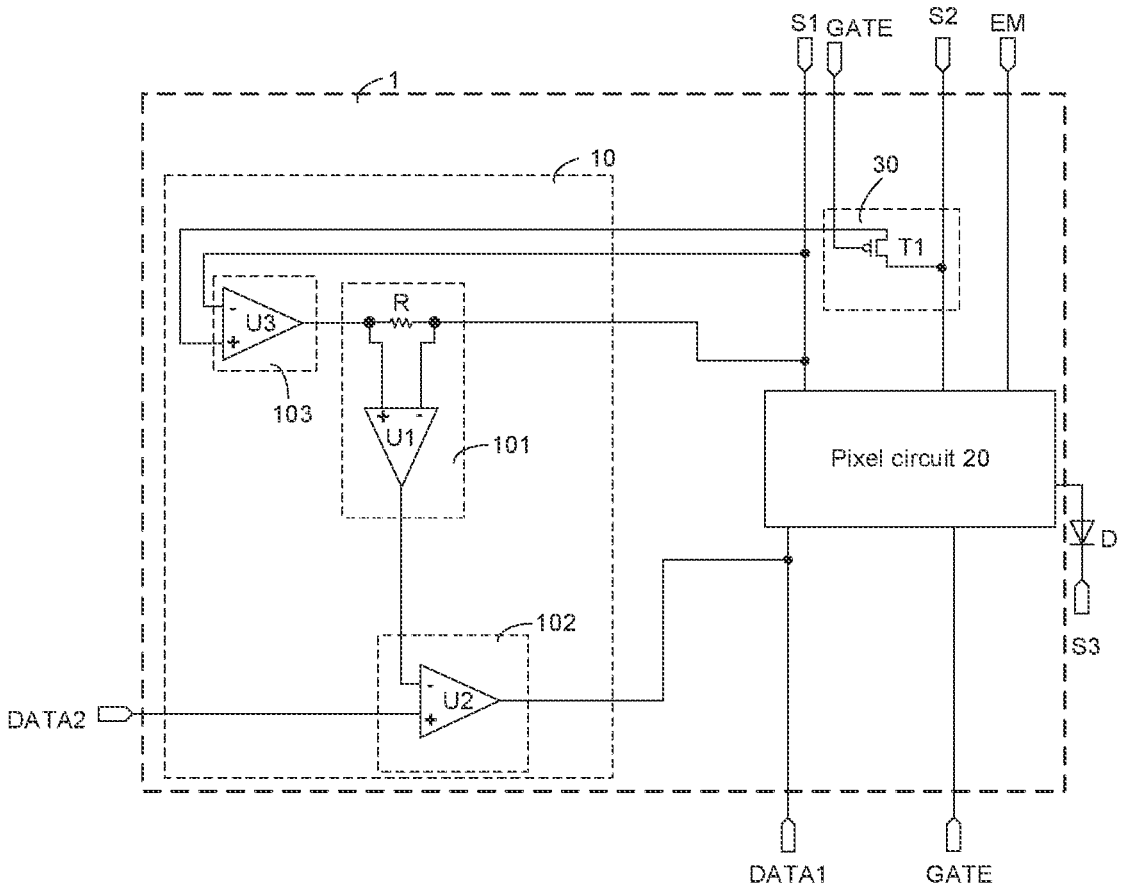
FIG. 10 is a schematic diagram of yet another driving circuit, in accordance with some embodiments.

For example, as shown in FIG. 10, the selection circuit 30 includes a first transistor T1. A control electrode of the first transistor T1 is coupled to the scan signal terminal GATE, a first electrode of the first transistor T1 is coupled to the second signal terminal S2, and a second electrode of the first transistor T1 is coupled to the voltage follower sub-circuit 103. For example, the second electrode of the first transistor T1 is coupled to the second input terminal of the third amplifier U3.

Figure 11:
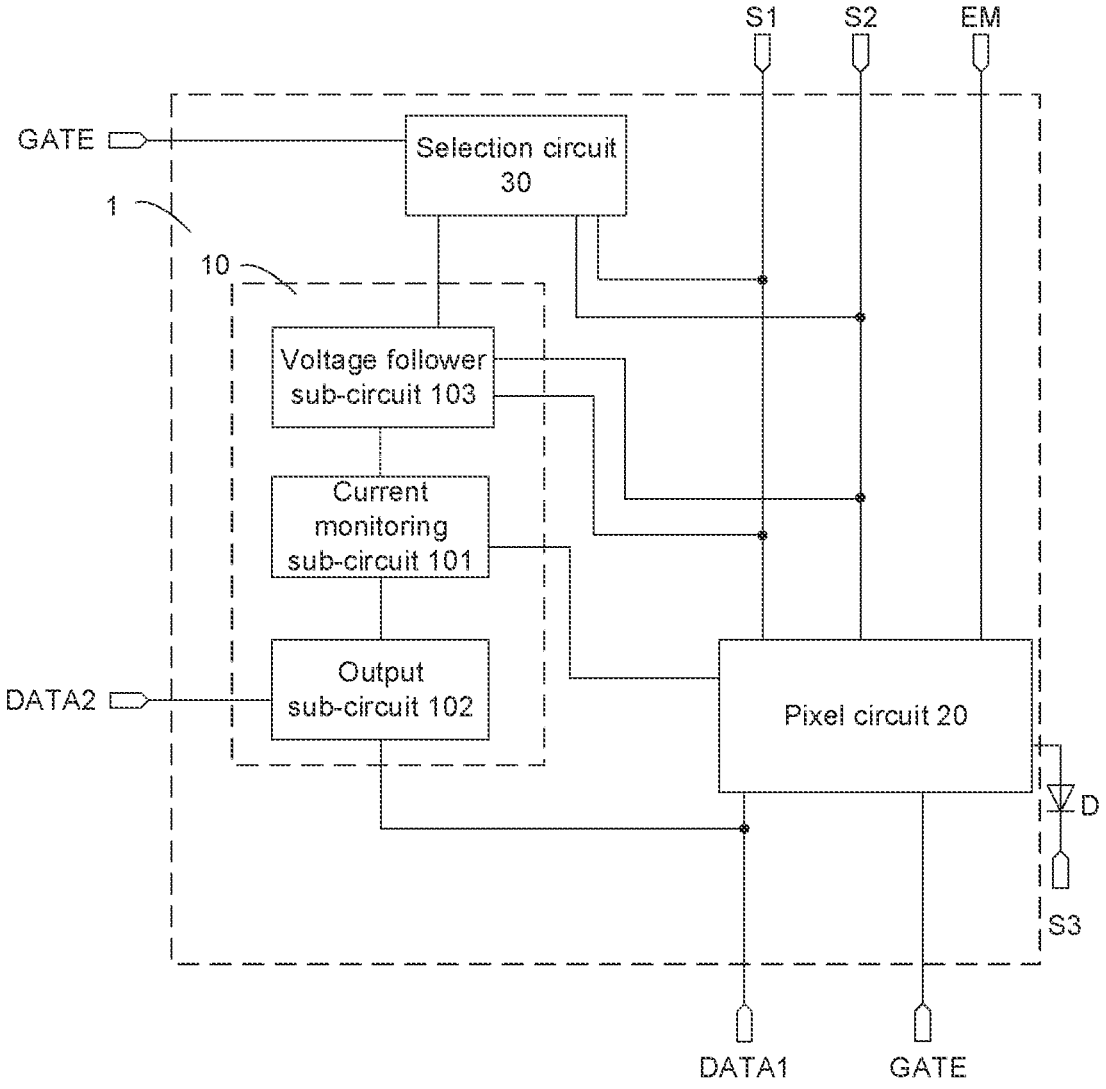
FIG. 11 is a block diagram of yet another driving circuit, in accordance with some embodiments.

In some embodiments, as shown in FIG. 11, the selection circuit 30 is further coupled to the first signal terminal S1. The selection circuit 30 is further configured to transmit the previous first signal from the first signal terminal S1 to the voltage follower sub-circuit 103 in response to the scan signal received at the scan signal terminal GATE.

Figure 12:
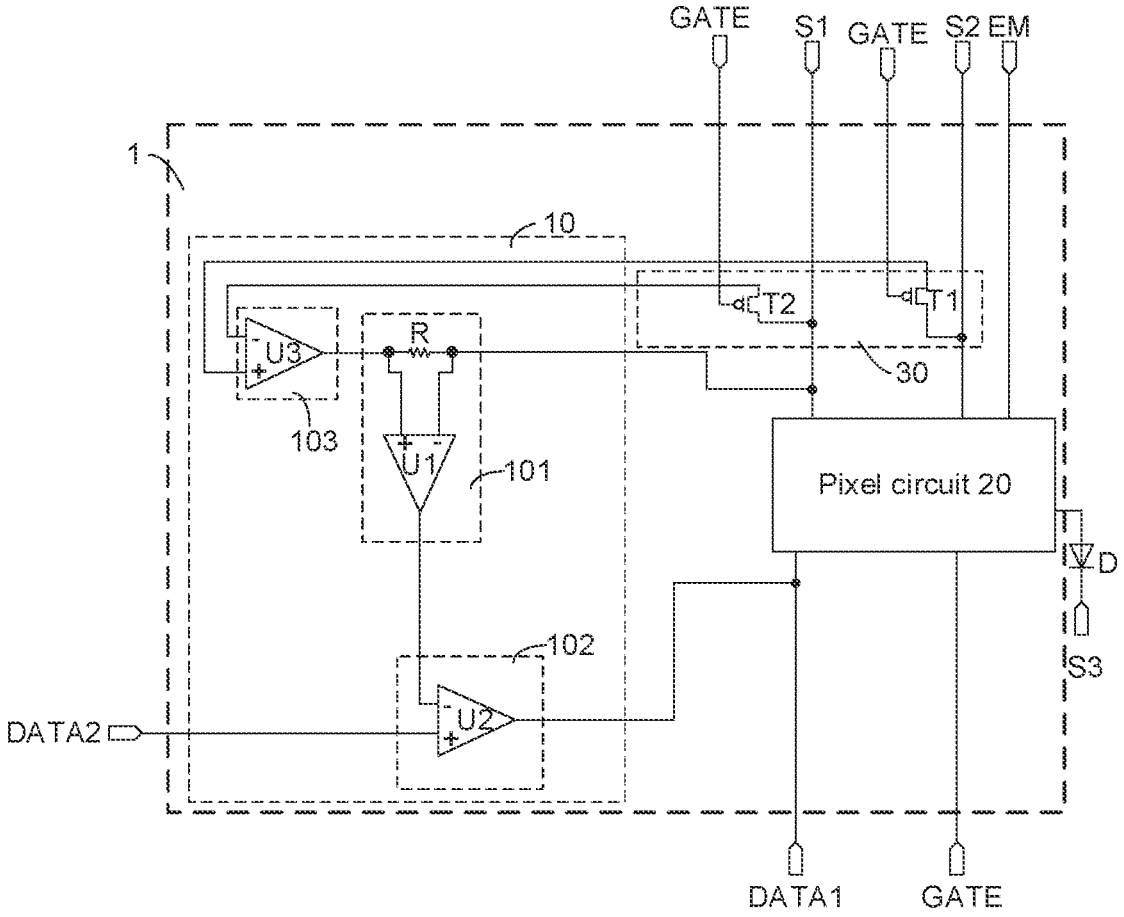
FIG. 12 is a schematic diagram of yet another driving circuit, in accordance with some embodiments.

For example, as shown in FIG. 12, the selection circuit 30 further includes a second transistor T2 in addition to the first transistor T1. A control electrode of the second transistor T2 is coupled to the scan signal terminal GATE, a first electrode of the second transistor T2 is coupled to the first signal terminal S1, and a second electrode of the second transistor T2 is coupled to the voltage follower sub-circuit 103. For example, the second electrode of the second transistor T2 is coupled to the first input terminal of the third amplifier U3.

For example, the at least one pixel circuit 20 coupled to the control circuit 10 includes multiple pixel circuits 20 in a same column. That is, the pixel circuits 20 in the same column are coupled to a same control circuit 10. For example, the at least one selection circuit 30 coupled to the control circuit 10 includes multiple selection circuits 30. Each selection circuit 30 is coupled to a respective one of the multiple pixel circuits 20. In this case, the number of the selection circuits 30 coupled to the control circuit 10 is, for example, equal to the number of the pixel circuits 20 coupled to the control circuit 10. For example, the number of pixel circuits 10 in the display panel 100 is equal to the number of selection circuits 30 in the display panel 100.

In some embodiments, the driving circuit 1 includes a plurality of control circuits 10, a plurality of pixel circuits 20, and a plurality of selection circuits 30. Each control circuit 10 is coupled to at least one pixel circuit 20 and at least one selection circuit 30.

Figure 13:
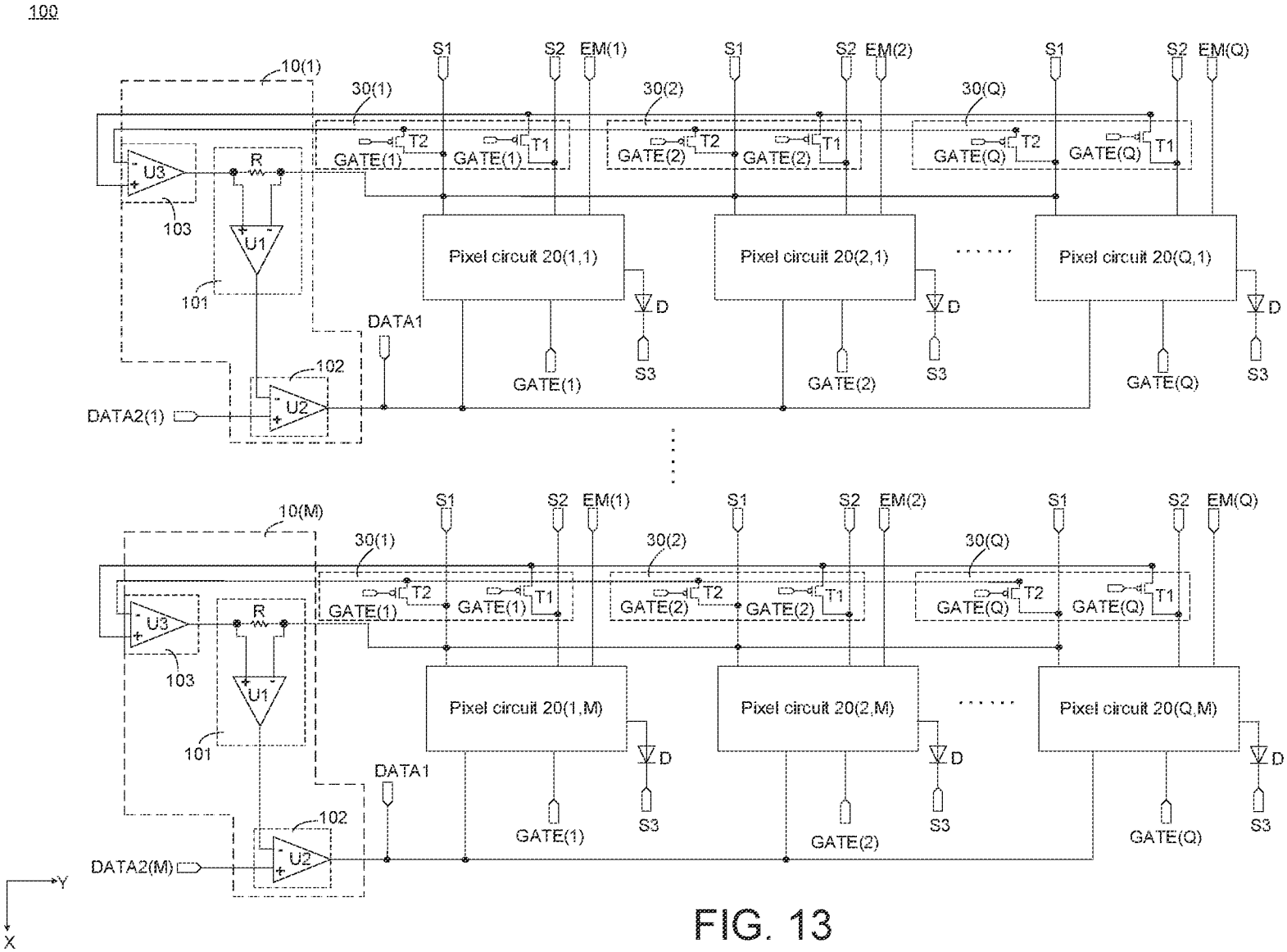
FIG. 13 is a circuit diagram of another display panel, in accordance with some embodiments.

In some examples, referring to FIG. 13, the driving circuit 1 includes pixel circuits 20 of Q rows and M columns, and M control circuits 10 (e.g., a control circuit 10 (1), . . . , and a control circuit 10 (M)). Q and M are both positive integers. For example, referring to FIG. 13, the pixel circuit 20 (1, 1) in the 1st column and the 1st row to the pixel circuit 20 (Q, 1) in the 1st column and the Q-th row are all coupled to the 1st control circuit 10 (1); the pixel circuit 20 (1, 2) in the 2nd column and the 1st row to the pixel circuit 20 (Q, 2) in the 2nd column and the Q-th row are all coupled to the 2nd control circuit 10 (2); and so on; and the pixel circuit 20 (1, M) in the M-th column and the 1st row to the pixel circuit 20 (Q, M) in the M-th column and the Q-th row are all coupled to the M-th control circuit 10 (M).

In some examples, a control circuit 10 may be coupled to multiple pixel circuits 20 and multiple selection circuits 30. For example, referring to FIG. 14, a control circuit 10 is coupled to Q pixel circuits 20 (for example, the pixel circuit 20 (1), the pixel circuit 20 (2), and the pixel circuit 20 (Q)) in a same column, and each pixel circuit 20 is coupled to a selection circuit 30. For example, the pixel circuit 20 (1) is coupled to the selection circuit 30 (1), the pixel circuit 20 (2) is coupled to the selection circuit 30 (2), and the pixel circuit 20 (Q) is coupled to the selection circuit 30 (0). That is, the control circuit 10 is also coupled to Q selection circuits 30.

For example, the plurality of control circuits 10 (e.g., the control circuit 10 (1) to the control circuit 10 (M) shown in FIG. 13) may all be included in the source driver. For example, the selection circuit 30 may be included in the sub-pixel. In this way, pixel circuits 20 and selection circuits 30 in a same column of sub-pixels are coupled to a same control circuit 10. For the selection circuits 30 coupled to the control circuit 10, one of the selection circuits 30 is selectively turned on, so that a pixel circuit 20 coupled to the turned-on selection circuit 30 may exchange signals with the control circuit 10 through the turned-on selection circuit 30.

In some examples, the display panel 100 further includes first signal lines. A first signal line is coupled to a control circuit 10 and first signal terminals S1, and the first signal line is used for transmitting the first signal to the first signal terminals S1. For example, each first signal line is coupled to a respective control circuit 10 and corresponding first signal terminals S1.

In some examples, the display panel 100 further includes second signal lines. A second signal line is coupled to second signal terminals S2, and the second signal line is used for transmitting the second signal to the second signal terminals S2. For example, each second signal line is coupled to multiple second signal terminal S2.

It can be understood that since there are distributed resistances on the first signal lines and the second signal lines, each of the signal lines will produce a voltage drop (i.e., IR drop) during signal transmission (i.e., current transmission). In this case, for the plurality of sub-pixels P in the display panel 100, during transmission of a first signal to a sub-pixel through a first signal line and transmission of a second signal to the sub-pixel through a second signal line, amplitudes (for example, voltages) of the first signal and the second signal will drop by a small value, and there may be a certain difference between the first signal at the first signal terminal and the second signal at the second signal terminal. Therefore, the amplitudes of the first signals and the second signals received by the pixel circuits 20 in the display panel 100 (for example, pixel circuits 20 in a same column) may not be necessarily the same, which may easily cause non-uniform display.

However, in the embodiments of the present disclosure, the first transistor T1 in the selection circuit 30 may be turned on to connect the second signal terminal S2 coupled to the pixel circuit 30 to the voltage follower sub-circuit 103 in the control circuit 10, so that an amplitude of a signal transmitted to the second input terminal of the third amplifier U3 in the voltage follower sub-circuit 103 is equal to an amplitude of the second signal of the pixel circuit 30 received from the second signal terminal S2. The second transistor T2 in the selection circuit 30 may be turned on to connect the first signal terminal S1 coupled to the pixel circuit 20 to the voltage follower sub-circuit 103 in the control circuit 10, so that an amplitude of a signal transmitted to the first input terminal S1 of the third amplifier U3 in the voltage follower sub-circuit 103 is equal to an amplitude of the first signal of the pixel circuit 20 received from the first signal terminal S1. Moreover, since the first transistor T1 and the second transistor T2 in the selection circuit 30 are turned on simultaneously, the third amplifier U3 in the voltage follower sub-circuit 103 may provide another first signal having a same amplitude as the second signal to the pixel circuit 20 according to the received first signal and second signal, so that the amplitude of the another first signal received by the pixel circuit 20 is equal to the amplitude of the second signal received by the pixel circuit 20 from the second signal terminal S2. In this way, in a case where the display panel 100 includes a plurality of sub-pixels P and each sub-pixel P includes a pixel circuit 20, an amplitude (i.e., voltage) of a first signal actually received by each pixel circuit 20 and an amplitude (i.e., voltage) of a second signal received by the pixel circuit 20 are equal.

In addition, for example, first signal terminals S1 corresponding to pixel circuits 20 in a same column of sub-pixels may be coupled to a same first signal line, first signal terminals S1 corresponding to pixel circuits 20 in a same row of sub-pixels P are coupled to different first signal lines, and the different first signal lines are insulated from each other. Second signal terminals S2 corresponding to pixel circuits 20 in a same column of sub-pixels in the display panel 100 are coupled to a same second signal line, and second signal terminals S2 corresponding to pixel circuits 20 in a same row of sub-pixels P in the display panel 100 are coupled to a same second signal line. All the second signal lines are coupled with each other, and the second signal lines may have a mesh structure.

In some examples, the display panel 100 further includes third signal lines. A third signal line is coupled to a third signal terminal S3 corresponding to a light-emitting device D. For example, each third signal line is coupled to a respective third signal terminal S3 coupled to a respective light-emitting device D. Signals transmitted by the third signal lines coupled to the third signal terminals S3 corresponding to all the light-emitting devices D are the same.

Figure 15:
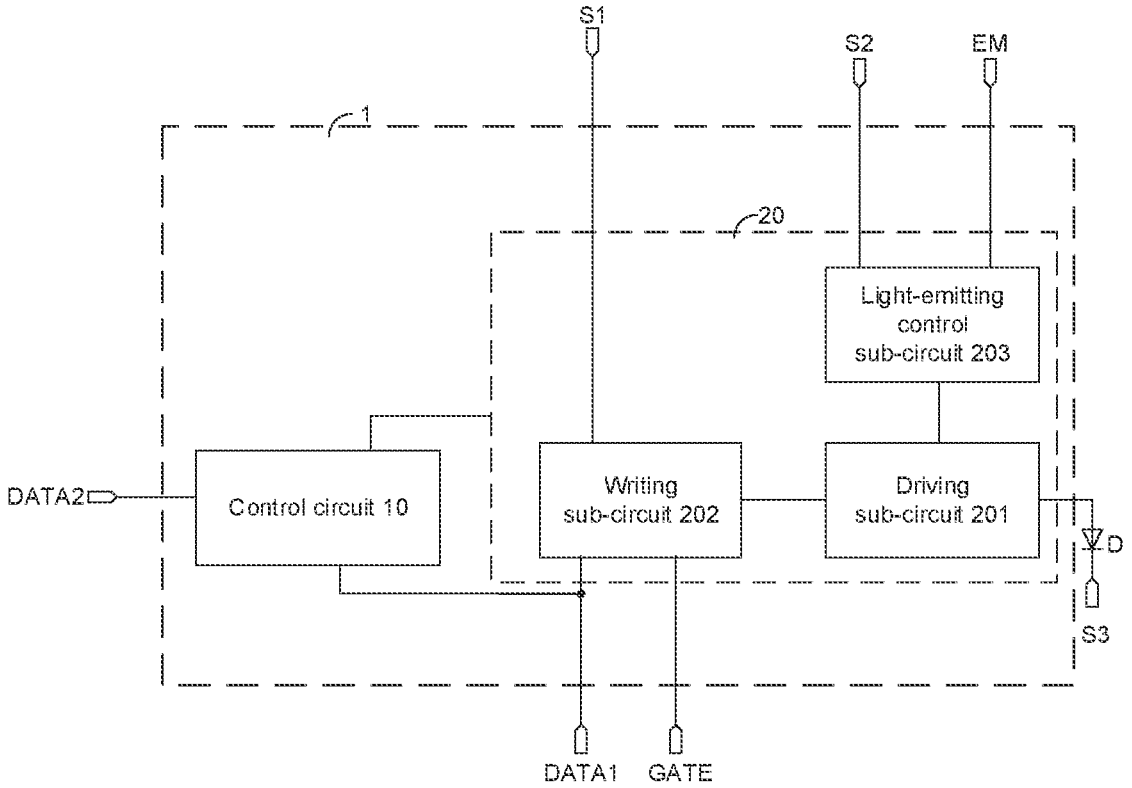
FIG. 15 is a block diagram of yet another driving circuit, in accordance with some embodiments.

In some embodiments, as shown in FIG. 15, the pixel circuit 20 includes a driving sub-circuit 201, a writing sub-circuit 202 and a light-emitting control sub-circuit 203. The driving sub-circuit 201 is coupled to the light-emitting device D, The writing sub-circuit 202 is coupled to the scan signal terminal GATE, the first data signal terminal DATA1, the first signal terminal S1, the control circuit 10 and the driving sub-circuit 201. The light-emitting control sub-circuit 203 is coupled to the enable signal terminal EM, the second signal terminal S2 and the driving sub-circuit 201.

The writing sub-circuit 201 is configured to transmit the another first data signal received from the control circuit 10 to the driving sub-circuit 201 in response to the scan signal received at the scan signal terminal GATE, and transmit the first signal to the driving sub-circuit 201 in response to the scan signal received at the scan signal terminal GATE. The driving sub-circuit 201 is configured to provide the another first driving signal to the light-emitting device D according to the another first data signal and the first signal. For example, the another first driving signal may be a first driving current. In this case, the light-emitting device D may be driven to emit light by the another first driving signal.

The light-emitting control sub-circuit 203 is configured to transmit the second signal from the second signal terminal S2 to the driving sub-circuit 201 in response to the enable signal received at the enable signal terminal EM, The driving sub-circuit 203 is further configured to provide the second driving signal to the light-emitting device D according to the another first data signal and the second signal. For example, the second driving signal may be a second driving current. In this case, the light-emitting device may be driven to emit light by the second driving signal.

Figure 16:
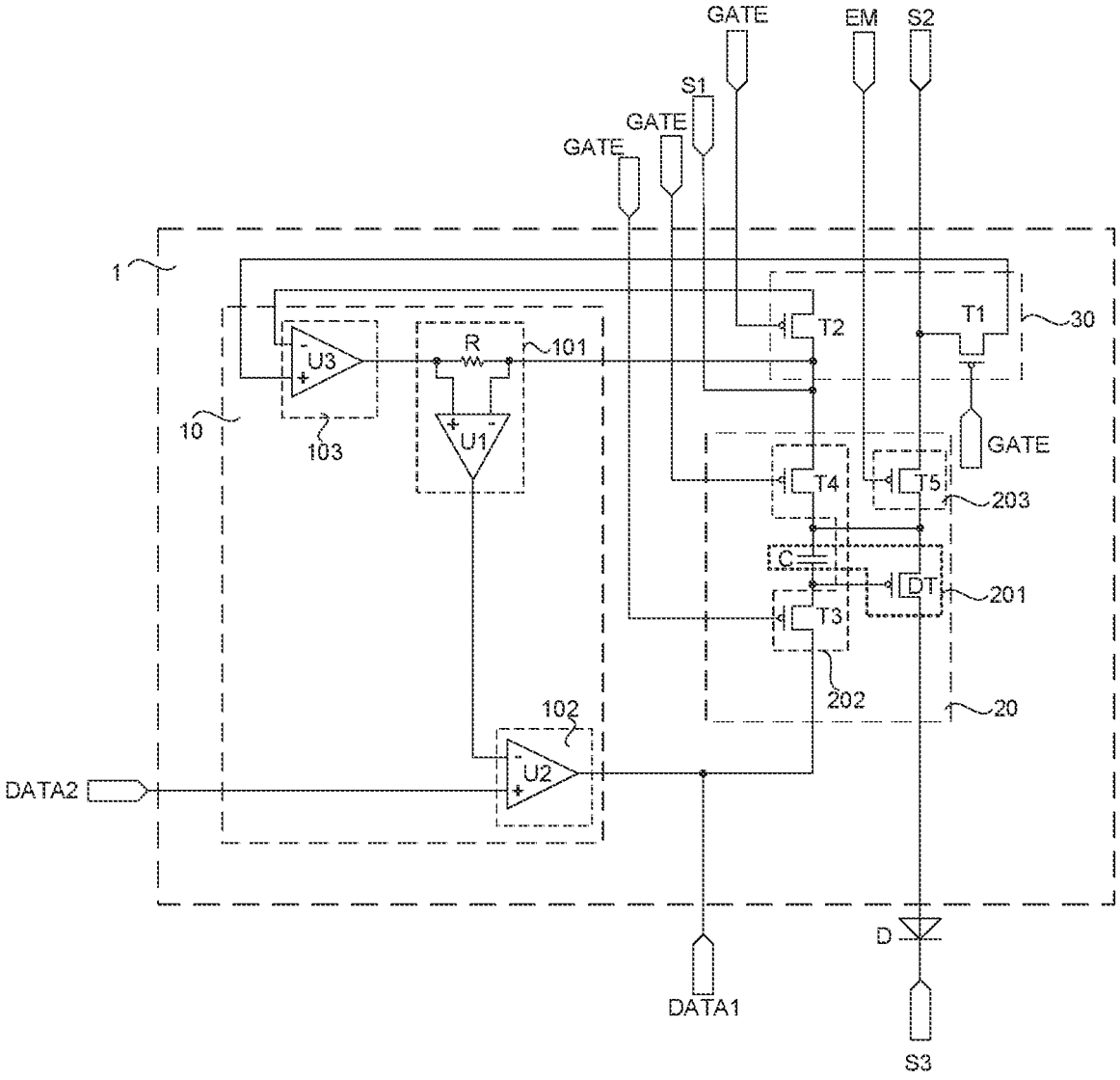
FIG. 16 is a circuit diagram of yet another driving circuit, in accordance with some embodiments.

For example, as shown in FIG. 16, the driving sub-circuit 201 includes a driving transistor DT and a capacitor C. A control electrode of the driving transistor DT is coupled to a first electrode of the capacitor C, a first electrode of the driving transistor DT is coupled to a second electrode of the capacitor C, and a second electrode of the driving transistor DT is coupled to the light-emitting device D.

For example, as shown in FIG. 16, the writing sub-circuit 202 includes a third transistor T3 and a fourth transistor T4. A control electrode of the third transistor T3 is coupled to the scan signal terminal GATE, a first electrode of the third transistor T3 is coupled to the first data signal terminal DATA1, and a second electrode of the third transistor T3 is coupled to the driving sub-circuit 201. For example, the second electrode of the third transistor T3 is coupled to the first electrode of the capacitor C. A control electrode of the fourth transistor T4 is coupled to the scan signal terminal GATE, a first electrode of the fourth transistor T4 is coupled to the first signal terminal S1 and the control circuit 10, and a second electrode of the fourth transistor T4 is coupled to the driving sub-circuit 201. For example, the second electrode of the fourth transistor T4 is coupled to the second electrode of the capacitor C.

For example, as shown in FIG. 16, the third transistor T3 in the writing sub-circuit 202 is turned on to write a first data signal from the first data signal terminal DATA1 into the first electrode of the capacitor C, and the fourth transistor T4 is turned on to write a previous first signal from the first signal terminal S1 into the second electrode of the capacitor C. In this way, a voltage of the control electrode of the driving transistor DT in the driving sub-circuit 201 is a voltage of the first data signal, and a voltage of the first electrode of the driving transistor DT is the voltage of the previous first signal. The driving transistor DT may obtain a first driving signal, that is, a first driving current, according to a voltage difference between the control electrode and the first electrode, and the first driving signal may drive the light-emitting device D to emit light. In this case, a first current path is formed between the first signal terminal and the third signal terminal.

The control circuit 10 may be coupled to the first conductive path (or the first current path), provide a first signal having a same amplitude as the second signal to the pixel circuit 20, monitor the first driving signal (or the first driving current), and provide another first data signal to the pixel circuit 20 according to the first driving signal and the second data signal. The driving transistor DT may obtain another first driving signal, that is, another first driving current, according to a voltage difference between the another first data signal and the first signal having the same amplitude as the second signal, and the another first driving signal may drive the light-emitting device D to emit light, so that the amplitude of the second driving signal (or second driving current) obtained subsequently is equal or approximately equal to the amplitude of the another first driving signal (or first driving current). Moreover, the control circuit 10 may also adjust the magnitude of the another first driving signal, so that the amplitude of the another first driving signal is in direct proportion to the amplitude of the second data signal.

For example, as shown in FIG. 16, the light-emitting control sub-circuit 203 includes a fifth transistor T5. A control electrode of the fifth transistor T5 is coupled to the enable signal terminal EM, a first electrode of the fifth transistor T5 is coupled to the second signal terminal S2, and a second electrode of the fifth transistor T5 is coupled to the driving sub-circuit 201. For example, the second electrode of the fifth transistor T5 is coupled to the first electrode of the driving transistor DT, and is also coupled to the second electrode of the capacitor C.

For example, the fifth transistor T5 in the light-emitting control sub-circuit 203 is turned on to write the second signal into the second electrode of the capacitor C, In this way, the voltage of the control electrode of the driving transistor DT in the driving sub-circuit 201 is still the voltage of the another first data signal, the voltage of the first electrode of the driving transistor DT is the voltage of the second signal, and the driving transistor DT may obtain the second driving signal, that is, the second driving current, according to a voltage difference between the control electrode and the first electrode. The second driving signal may drive the light-emitting device D to emit light. In this case, a second conductive path is formed between the second signal terminal and the third signal terminal. The amplitude of the second driving signal is equal to or approximately equal to the amplitude of the another first driving signal.

It will be noted that, the transistors (e.g., the driving transistor and the first to fifth transistors) used in the driving circuit 1 provided by the embodiments of the present disclosure may be enhancement transistors or depletion transistors; or, may be thin film transistors (TFTs), field effect transistors (FETs), metal-oxide-semiconductor field-effect transistors (MOSFETs) or other switching devices having the same characteristics, and the embodiments of the present disclosure are not limited thereto.

In some embodiments, in the driving circuit 1, a control electrode of each transistor is a gate, a first electrode of the transistor is one of a source and a drain, and a second electrode of the transistor is another one of the source and the drain. Since the source and the drain of the transistor may be symmetrical in structure, there may be no difference in structure between the source and the drain. That is, the first electrode and the second electrode of the transistor may be the same in structure. For example, in a case where the transistor is a P-type transistor, the first electrode of the transistor is the source, and the second electrode thereof is the drain. For example, in a case where the transistor is an N-type transistor, the first electrode of the transistor is the drain, and the second electrode thereof is the source. For example, the transistors used in the above driving circuit 1 are all P-type transistors.

In the driving circuit 1 provided by the embodiments of the present disclosure, specific implementation manners of the circuits (e.g., the pixel circuits, the control circuits and the selection circuits) and the sub-circuits (e.g., the current monitoring sub-circuits, the output sub-circuits, the voltage follower sub-circuits, the driving sub-circuits, the writing sub-circuits, and the light-emitting control sub-circuits) are not limited to the manners described above, and may be any implementation manner as used, such as a conventional connection manner well known to a person skilled in the art, as long as the realization of corresponding functions may be guaranteed. The above examples do not limit the protection scope of the present disclosure. In practical applications, a person skilled in the art may choose to use or not to use one or more of the above circuits according to actual situations. Various combinations and modifications based on the above circuits do not depart from the principle of the present disclosure, and details are not described herein again.

In the following, the operation process of the driving circuit 1 will be described. For example, as shown in FIG. 13, the driving circuit 1 includes Q rows of pixel circuits 20, and each control circuit 10 is coupled to a column of pixel circuits 20.

Figure 17:
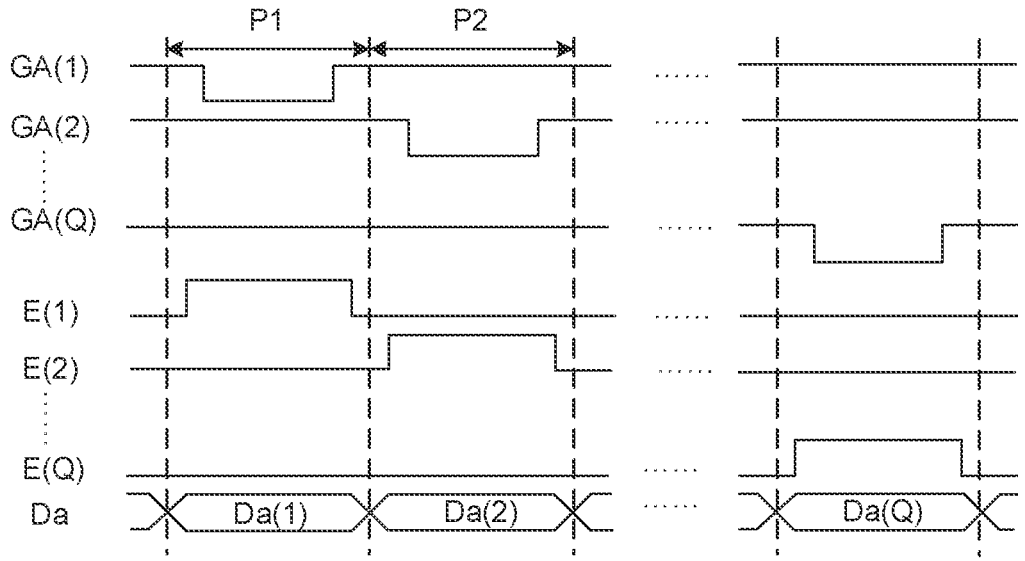
FIG. 17 is a signal timing diagram of a driving method of a driving circuit, in accordance with some embodiments.

Referring to FIGS. 13 and 17, for pixel circuits 20 of the 1st row, a scan signal received by each pixel circuit is GA(1), an enable signal received by each pixel circuit is E(1), and a second data signal Da received by a corresponding control circuit 10 is Da(1) segment; for the pixel circuits of the 2nd row, a scan signal received by each pixel circuit is GA(2), an enable signal received by each pixel circuit is E(2), and a second data signal Da received by a corresponding control circuit 10 is Da(2); and so on; and for the pixel circuits of the Q-th row, a scan signal received by each pixel circuit is GA(Q), an enable signal received by each pixel circuit is E(Q), and a second data signal Da received by a corresponding control circuit 10 is Da(Q), For example, transistors in the driving circuit 1 are all P-type transistors.

In this case, referring to FIGS. 16 and 17, in a first period P1, a first data signal received at the first data signal terminal DATA1 is written into the pixel circuit 20 in response to a scan signal (e.g., a low-level scan signal) received at the scan signal terminal GATE. The selection circuit 30 is turned on in response to the scan signal and transmits a previous first signal from the first signal terminal S1 and a second signal from the second signal terminal S2 to the control circuit 10, so that a first signal having a same amplitude as the second signal from the second signal terminal S2 is generated by the control circuit 10 according to the previous first signal and the second signal. The pixel circuit 20 receives the first signal and generates a first driving signal according to the first signal and the first data signal.

Then, the control circuit 10 monitors the first driving signal, and outputs another first data signal to the pixel circuit 20 according to the first driving signal and a second data signal from the second data signal terminal DATA2. The pixel circuit 20 generates another first driving signal according to the first signal and the another first data signal.

For example, in the first period P1, the third transistor T3 in the writing sub-circuit 202 is turned on in response to a low-level scan signal received at the scan signal terminal GATE. In this case, a first data signal from the first data signal terminal DATA1 is written into the driving sub-circuit 201. In addition, the first transistor T1 and the second transistor T2 in the selection circuit 30 are turned on in response to the low-level scan signal received at the scan signal terminal GATE. In this case, a first signal having a same amplitude as a second signal from the second signal terminal S2 is generated according to a previous first signal from the first signal terminal S1 and the second signal. Furthermore, the fourth transistor T4 in the writing sub-circuit 202 is turned on in response to the low-level scan signal received at the scan signal terminal GATE. In this case, the first signal having the same amplitude as the second signal is written into the driving sub-circuit 201. Potentials of the first electrode of the driving transistor DT and the second electrode of the capacitor C in the driving sub-circuit 201 are the potential of the first signal, and potentials of the control electrode of the driving transistor DT and the first electrode of the capacitor C are the potential of the first data signal. The driving transistor DT generates a first driving signal according to the first signal and the first data signal, and transmits the first driving signal to the light-emitting device D. The fifth transistor T5 in the light-emitting control sub-circuit 203 is in the off-state.

Next, the second amplifier U2 outputs another first data signal to the driving sub-circuit 201 through the turned on third transistor T3. In this case, the driving transistor DT generates another first driving signal according to the first signal and the another first data signal.

In this case, the current monitoring sub-circuit 101, the output sub-circuit 102 and the voltage follower sub-circuit 103 in the control circuit 10, the writing sub-circuit 202 and the driving sub-circuit 201 in the pixel circuit 20, and the selection circuit 30 form a conductive path. The voltage follower sub-circuit 103 may provide a first signal having a same amplitude as the second signal to the driving transistor DT according to a previous first signal from the first signal terminal S1 and the second signal. The driving transistor DT in the pixel circuit 20 generates a first driving signal according to the first signal and the first data signal, and the current monitoring sub-circuit 101 in the control circuit 10 monitors the first driving signal. The current monitoring sub-circuit 101 outputs a third signal according to the first driving signal, and the output sub-circuit 102 outputs another first data signal to the driving transistor DT according to the third signal and the second data signal Da.

In this case, the current monitoring sub-circuit 101, the output sub-circuit 102 and the pixel circuit 20 form a current depth negative feedback loop, and there exists virtual short between the first input terminal and the second input terminal of the second amplifier U2. That is, the potential of the first input terminal of the second amplifier U2 is equal to the potential of the second input terminal of the second amplifier U2, that is, the third signal and the second data signal have the same potential, and it can be obtained that the amplitude of the another first driving signal is related to the amplitude of the second data signal. For example, the amplitude of the another first driving signal is in direct proportion to the amplitude of the second data signal. In this way, the amplitude of the another first driving signal may be controlled by controlling the amplitude of the second data signal, so that the another first driving signal received by the light-emitting device D is independent of the threshold voltage of the driving transistor DT.

In a second period P2, referring FIGS. 16 and 17, in response to the enable signal received at the enable signal terminal EM, the pixel circuit 20 provides a second driving signal to the light-emitting device D according to the second signal received at the second signal terminal S2 and the another first data signal. In this case, the light-emitting device D emits light according to the second driving signal.

In some examples, referring to FIG. 16, in response to the enable signal received at the enable signal terminal EM, the light-emitting control sub-circuit 203 transmits the second signal received at the second signal terminal S2 to the driving sub-circuit 201. The driving sub-circuit 201 provides a second driving signal to the light-emitting device D according to the another first data signal and the second signal.

For example, referring to FIG. 16, the fifth transistor T5 in the light-emitting control sub-circuit 203 is turned on in response to the low-level enable signal received at the enable signal terminal EM, and the fifth transistor T5 transmits the second signal received at the second signal terminal S2 to the driving sub-circuit 201. In this case, the second electrode of the capacitor C and the first electrode of the driving transistor DT have a same potential as the second signal, and the first electrode of the capacitor C maintains the potential of the previous period. That is, the potential of the first electrode of the capacitor C is the potential of the another first data signal, that is, the potential of the control electrode of the driving transistor DT is the potential of the another first data signal, Therefore, the driving transistor DT in the driving sub-circuit 201 generates a second driving signal according to the second signal and the another first data signal, and transmits the second driving signal to the light-emitting device D.

In addition, since the third transistor T3 and the fourth transistor T5 in the writing sub-circuit 202, and the first transistor T1 and the second transistor T2 in the selection circuit 30 are all in the off-state, the control circuit 10 and the pixel circuit 20 do not form a conductive path. In this case, the pixel circuit 20 may generate a second driving signal according to the another first data signal written in the previous period and the second signal, the amplitude of the second driving signal is equal to or approximately equal to the amplitude of the another first driving signal, and the amplitude of the second driving signal is also related to the amplitude of the second data signal. In this way, the amplitude of the second driving signal may be controlled by controlling the amplitude of the second data signal, so that the second driving signal received by the light-emitting device D is independent of the threshold voltage of the driving transistor DT.

Therefore, for the display panel 100 including the driving circuit 1 in the embodiments of the present disclosure, a feedback mechanism, such as a driving signal feedback mechanism, that is, a driving current feedback mechanism, is introduced in the display panel 100, so as to increase the charging speed of the capacitor C in the pixel circuit 20. Moreover, by controlling the amplitude of the driving signal (or the driving current) in the pixel circuit 20, which is related to the brightness of the light-emitting device, the display uniformity of the display panel 100 is directly compensated during the charging process of the capacitor C in the pixel circuit 20, and thereby it is not necessary to provide a compensation circuit with a complicated configuration mechanism, and the circuit structure may be simplified. In the process of charging the capacitor C in the pixel circuit 20, the amplitudes of the second signal and the first signal in the display panel 100 are also compensated, so as to avoid a problem of display brightness uniformity reducing due to non-uniform voltage distribution in the display panel in the signal transmission process.

Some embodiments of the present disclosure provide a driving method of a pixel circuit. For example, the driving circuit is the driving circuit 1 in any of the above embodiments. For example, referring to FIGS. 4 and 14, the driving circuit 1 includes the control circuit 10 and the at least one pixel circuit 20. Each pixel circuit 20 is coupled to the scan signal terminal GATE, the first data signal terminal DATA1, the second signal terminal S2, the enable signal terminal EM, and the light-emitting device D; and the control circuit 10 is coupled to the second data signal terminal DATA2 and the at least one pixel circuit 20.

The driving method includes: writing, by the pixel circuit 20, the first data signal received at the first data signal terminal DATA1 in response to the scan signal received at the scan signal terminal GATE, generating, by the pixel circuit 20, a first driving signal according to a first signal and the first data signal; monitoring, by the control circuit 10, the first driving signal; providing, by the control circuit 10, another first data signal to the pixel circuit 20 according to the first driving signal and a second data signal received at the second data signal terminal DATA2; providing, by the pixel circuit 20, another first driving signal to the light-emitting device D according to the first signal and the another first data signal; and in response to an enable signal received at the enable signal terminal EM, providing, by the pixel circuit 20, a second driving signal to the light-emitting device D according to a second signal received at the second signal terminal S2 and the another first data signal. An amplitude of the another first driving signal and an amplitude of the second driving signal are equal or approximately equal.

In some examples, the first signal and the second signal are approximately identical.

It should be noted that, specific working conditions of the driving method of the above driving circuit may be referred to the description of the corresponding portion of the driving circuit above, and details are not described herein again.

In addition, the beneficial effects of the foregoing driving method are the same as the beneficial effects of the driving circuit described in any of the above embodiments, and will not be described herein again.

The foregoing descriptions are merely some specific implementation manners of the present disclosure, but the protection scope of the present disclosure is not limited thereto, and changes or replacements that any person skilled in the art could conceive of within the technical scope disclosed by the present disclosure should be within the protection scope of the present disclosure. Therefore, the protection scope of the present disclosure shall be subject to the protection scope of the claims.

What is claimed is:

1. A driving circuit; comprising:

at least one pixel circuit, each pixel circuit being coupled to a scan signal terminal, a first data signal terminal, a second signal terminal, and an enable signal terminal; and a control circuit coupled to a second data signal terminal and the at least one pixel circuit, wherein the pixel circuit is configured to write a first data signal received at the first data signal terminal in response to a scan signal received at the scan signal terminal; and generate a first driving signal according to a first signal and the first data signal;

the control circuit is configured to monitor the first driving signal, and provide another first data signal to the pixel circuit according to a second data signal received at the second data signal terminal and the first driving signal, and the pixel circuit is configured to be further coupled to a light-emitting device; and is further configured to: provide another first driving signal to the light-emitting device according to the first signal and the another first data signal; and in response to an enable signal received at the enable signal terminal, provide a second driving signal to the light-emitting device according to a second signal received at the second signal terminal and the another first data signal, wherein an amplitude of the another first driving signal and an amplitude of the second driving signal are approximately equal.

2. The driving circuit according to claim 1, wherein the pixel circuit is configured to provide the another first driving signal with an amplitude in direct proportion to an amplitude of the second data signal to the light-emitting device according to the first signal and the another first data signal.

3. The driving circuit according to claim 1, wherein the control circuit includes:

a current monitoring sub-circuit coupled to the at least one pixel circuit, wherein the current monitoring sub-circuit is configured to monitor the first driving signal; and output a third signal according to the first driving signal; and an output sub-circuit coupled to the at least one pixel circuit, the second data signal terminal and the current monitoring sub-circuit, wherein the output sub-circuit is configured to output the another first data signal to the pixel circuit according to the third signal from the current monitoring sub-circuit and the second data signal.

4. The driving circuit according to claim 3, wherein the current monitoring sub-circuit includes a resistor and a first amplifier, a first end of the resistor is coupled to the at least one pixel circuit, a first input terminal of the first amplifier is coupled to the first end of the resistor, and a second input terminal of the first amplifier is coupled to a second end of the resistor; and the output sub-circuit includes a second amplifier, a first input terminal of the second amplifier is coupled to an output terminal of the first amplifier, a second input terminal of the second amplifier is coupled to the second data signal terminal, and an output terminal of the second amplifier is coupled to the at least one pixel circuit.

5. The driving circuit according to claim 3, wherein the control circuit further includes a voltage follower sub-circuit coupled to a first signal terminal, the second signal terminal and the at least one pixel circuit; and the voltage follower sub-circuit is configured to provide the first signal having a same amplitude as the second signal to the pixel circuit according to a previous first signal from the first signal terminal and the second signal from the second signal terminal.

6. The driving circuit according to claim 5, wherein the voltage follower sub-circuit includes a third amplifier; a first input terminal of the third amplifier is coupled to the first signal terminal, a second input terminal of the third amplifier is coupled to the second signal terminal, and an output terminal of the third amplifier is coupled to the at least one pixel circuit.

7. The driving circuit according to claim 5, wherein the first signal terminal and the second signal terminal are comprised in the driving circuit, and the first signal terminal is coupled to the second signal terminal.

8. The driving circuit according to claim 5, further comprising at least one selection circuit coupled to the control circuit, wherein a selection circuit in the at least one selection circuit is coupled to at least the scan signal terminal, the voltage follower sub-circuit and the second signal terminal, and the selection circuit is configured to transmit the second signal from the second signal terminal to the voltage follower sub-circuit in response to the scan signal received at the scan signal terminal.

9. The driving circuit according to claim 8, wherein the selection circuit includes a first transistor, a control electrode of the first transistor is coupled to the scan signal terminal, a first electrode of the first transistor is coupled to the second signal terminal, and a second electrode of the first transistor is coupled to the voltage follower sub-circuit.

10. The driving circuit according to claim 8, wherein the selection circuit is further coupled to the first signal terminal; and the selection circuit is further configured to transmit the previous first signal from the first signal terminal to the voltage follower sub-circuit in response to the scan signal received at the scan signal terminal.

11. The driving circuit according to claim 10, wherein the selection circuit includes:

a first transistor, a control electrode of the first transistor being coupled to the scan signal terminal, a first electrode of the first transistor being coupled to the second signal terminal, and a second electrode of the first transistor being coupled to the voltage follower sub-circuit; and a second transistor, a control electrode of the second transistor being coupled to the scan signal terminal, a first electrode of the second transistor being coupled to the first signal terminal, and a second electrode of the second transistor being coupled to the voltage follower sub-circuit.

12. The driving circuit according to claim 8, wherein the at least one pixel circuit includes pixel circuits, and the at least one selection circuit includes selection circuits, and each selection circuit is coupled to a respective one of the pixel circuits.

13. The driving circuit according to claim 1, wherein the pixel circuit includes a driving sub-circuit, a writing sub-circuit and a light-emitting control sub-circuit;

the writing sub-circuit is coupled to the scan signal terminal, the control circuit and the driving sub-circuit, and the writing sub-circuit is configured to transmit the another first data signal from the control circuit to the driving sub-circuit in response to the scan signal received at the scan signal terminal, and transmit the first signal to the driving sub-circuit in response to the scan signal received at the scan signal terminal;

the light-emitting control sub-circuit is coupled to the enable signal terminal, the second signal terminal and the driving sub-circuit, and the light-emitting control sub-circuit is configured to transmit the second signal from the second signal terminal to the driving sub-circuit in response to the enable signal received at the enable signal terminal; and the driving sub-circuit is configured to be coupled to the light-emitting device, and is configured to provide the another first driving signal to the light-emitting device according to the another first data signal and the first signal, and provide the second driving signal to the light-emitting device according to the another first data signal and the second signal.

14. The driving circuit according to claim 13, wherein the driving sub-circuit includes a driving transistor and a capacitor; a control electrode of the driving transistor is coupled to a first electrode of the capacitor; and a first electrode of the driving transistor is coupled to a second electrode of the capacitor, and a second electrode of the driving transistor is configured to be coupled to the light-emitting device.

15. The driving circuit according to claim 13, wherein the writing sub-circuit includes:

a third transistor, a control electrode of the third transistor being coupled to the scan signal terminal, a first electrode of the third transistor being coupled to the first data signal terminal, and a second electrode of the third transistor being coupled to the driving sub-circuit; and a fourth transistor, a control electrode of the fourth transistor being coupled to the scan signal terminal, a first electrode of the fourth transistor being coupled to the control circuit, and a second electrode of the fourth transistor being coupled to the driving sub-circuit.

16. The driving circuit according to claim 13, wherein the light-emitting control sub-circuit includes a fifth transistor;

a control electrode of the fifth transistor is coupled to the enable signal terminal, a first electrode of the fifth transistor is coupled to the second signal terminal, and a second electrode of the fifth transistor is coupled to the driving sub-circuit.

17. A display panel, comprising:

the driving circuit according to claim 1; and a plurality of light-emitting devices coupled to the driving circuit.

18. A display device, comprising the display panel according to claim 17.

19. A driving method of a driving circuit, the driving circuit including at least one pixel circuit and a control circuit coupled to the at least one pixel circuit, the driving method comprising:

writing, by each pixel circuit, a first data signal received at a first data signal terminal in response to a scan signal received at a scan signal terminal, generating, by the pixel circuit, a first driving signal according to a first signal and the first data signal;

monitoring, by the control circuit, the first driving signal;

providing, by the control circuit, another first data signal to the pixel circuit according to the first driving signal and a second data signal received at a second data signal terminal;

providing, by the pixel circuit, another first driving signal to a light-emitting device according to the first signal and the another first data signal; and in response to an enable signal received at an enable signal terminal, providing, by the pixel circuit, a second driving signal to the light-emitting device according to a second signal received at a second signal terminal and the another first data signal, wherein an amplitude of the another first driving signal and an amplitude of the second driving signal are approximately equal.

20. The driving method according to claim 19, wherein the first signal and the second signal are approximately identical.

* * * * *